US008900074B1

(12) United States Patent
Johnson et al.

(10) Patent No.: US 8,900,074 B1
(45) Date of Patent: Dec. 2, 2014

(54) RECONFIGURABLE SPORTS TRAINING DEVICE

(71) Applicants: Kevin F. Johnson, Martinsville, VA (US); Jason O. Niblett, Collinsville, VA (US)

(72) Inventors: Kevin F. Johnson, Martinsville, VA (US); Jason O. Niblett, Collinsville, VA (US)

( * ) Notice: Subject to any disclaimer, the term of this patent is extended or adjusted under 35 U.S.C. 154(b) by 0 days.

(21) Appl. No.: 14/303,580

(22) Filed: Jun. 12, 2014

Related U.S. Application Data

(60) Provisional application No. 61/858,475, filed on Jul. 25, 2013.

(51) Int. Cl.
*A63B 69/00* (2006.01)
*A63B 69/20* (2006.01)
*A63B 22/00* (2006.01)

(52) U.S. Cl.
CPC ..... *A63B 69/00* (2013.01); *A63B 69/205* (2013.01); *A63B 22/0046* (2013.01); *A63B 69/0097* (2013.01); *A63B 69/0071* (2013.01)
USPC ..... 473/422; 473/447; 473/454; 473/459

(58) Field of Classification Search
USPC ..... 273/398–402; 211/14, 15; D6/552; 206/315.1; 473/415, 416, 422, 446, 473/447, 476–478, 431–433, 454, 459, 462
See application file for complete search history.

(56) References Cited

U.S. PATENT DOCUMENTS 4,168,066 A * 9/1979 Sole et al. ..... 273/402
4,786,053 A * 11/1988 Barnes, Jr. ..... 473/416
5,160,138 A * 11/1992 Sanders ..... 473/438
D365,716 S * 1/1996 Rose, Sr. ..... D6/552
5,485,993 A * 1/1996 Lipsett ..... 473/448
5,584,480 A * 12/1996 Grimsrud ..... 473/416
5,603,617 A 2/1997 Light
5,660,550 A 8/1997 Roche
5,800,291 A * 9/1998 Grover ..... 473/447
5,980,399 A * 11/1999 Campbell et al. ..... 473/459
6,283,871 B1 9/2001 Briggs
6,348,028 B1 * 2/2002 Cragg ..... 482/148
D457,767 S * 5/2002 Schumacher ..... D6/552
6,544,132 B1 * 4/2003 Tvedt ..... 473/448
7,247,105 B2 * 7/2007 Huntsberger ..... 473/433
7,393,290 B2 * 7/2008 Martin et al. ..... 473/422
7,523,942 B2 * 4/2009 Chung ..... 273/317.1
7,892,150 B1 2/2011 Colley
8,444,533 B2 5/2013 Robinson
8,715,115 B2 * 5/2014 Storey, III ..... 473/433
2003/0224881 A1 * 12/2003 Vitello et al. ..... 473/447
2005/0192126 A1 * 9/2005 Remaklus ..... 473/447
2006/0003856 A1 * 1/2006 Bennett et al. ..... 473/447
2007/0010354 A1 * 1/2007 White ..... 473/447
2014/0200102 A1 * 7/2014 Frostino ..... 473/447

* cited by examiner

*Primary Examiner* — Mark Graham
(74) *Attorney, Agent, or Firm* — Richard C. Litman

(57) ABSTRACT

The reconfigurable sports training device includes a main base frame, a plurality of primary attachment components, a plurality of secondary attachment components, and a plurality of accessories so that one or more of the attachment components and accessories can be selectively coupled to the main base frame to form a user-defined sports training device. The main base frame includes a movable rack having a plurality of shelves for storing balls thereon and hollow corner posts. Each corner post has an attachment fixture disposed at the top to enable selective coupling of the attachment components and accessories in various combinations. When assembled, the primary and secondary attachment components form a framework to which the accessories can be mounted.

16 Claims, 14 Drawing Sheets

RECONFIGURABLE SPORTS TRAINING DEVICE

CROSS-REFERENCE TO RELATED APPLICATION

This application claims the benefit of U.S. Provisional Patent Application Ser. No. 61/858,475, filed Jul. 25, 2013.

BACKGROUND OF THE INVENTION

1. Field of the Invention

The present invention relates to training devices, and particularly to a reconfigurable sports training device with a plurality of attachments and accessories that transform the device into equipment geared toward training specific areas or skills of various sports activities.

2. Description of the Related Art

Many people enjoy exercise and physical activity, especially sports. Such activities promote health and general well-being. While the general populace may enjoy participating in sports to one degree or another, their participation is generally perfunctory and performed more as a form of exercise and/or group activity. For others, the individual's sport of choice is a more serious and competitive activity where they try to master the skills, strategies, and nuances necessary to compete and excel. This also requires a high level of commitment and effort.

Whatever the level of commitment or effort, the participant must maximize their physical conditioning and hone their skills in order to maximize their chances of success through training and numerous practice sessions. Each sport generally includes its own unique set of challenges and specialized set of maneuvers and skills to counter those challenges. For example, in basketball, players must learn to effectively shoot so that the basketball arcs over the vertically outstretched arms of an opponent. Such results can be seen in any level of play where the proficient player will shoot so that the basketball travels in a high parabolic arc towards the hoop, the high arc intended to overcome the opponent's attempts to block. In U.S. football, players must learn to tackle and to juke around opponents who may be in the way of the player trying to reach the first down marker or get into the end zone for a touchdown. In U.S. soccer or international football, players must practice and train their accuracy in kicking the ball into the net or improve their agility to maneuver around opponents using their feet.

All of the above examples can be practiced on the field or basketball court with other players, but specialized sports training devices have been developed to assist training these skills without requiring another player to represent the opponent. Some examples of sports training equipment include tackle shields and sleds (football), hurdles (track and soccer), training sticks or poles (soccer), catch nets (for various sports), ball pitching machines (e.g., tennis and baseball), defensive mannequins (basketball), and the like. While these training devices are suitable for training the player in a certain area or skill of a sport, most tend to be expensive and highly specialized. The expenses associated therewith can be prohibitive to some sports programs with limited finances. The specialized nature of such equipment also severely limits their versatility, since they would not be functional across multiple sports. Moreover, if players or users desire to train multiple skills, such considerations would require acquisition of a plurality of specialized training devices covering a wide range of skills, which results in more equipment to tote and store.

Additionally, some training devices can be difficult to transport and/or assemble/disassemble. Features such as portability and ease of assembly are of great benefit to those who must frequently move equipment around and store the same, especially if storage space is limited.

Thus, a reconfigurable sports training device solving the aforementioned problems is desired.

SUMMARY OF THE INVENTION

The reconfigurable sports training device includes a main base frame, a plurality of primary attachment components, a plurality of secondary attachment components, and a plurality of accessories so that one or more of the attachment components and accessories can be selectively coupled to the main base frame to form a user-defined training device. The main base frame includes a movable rack having hollow corner posts and a plurality of shelves for storing balls thereon. Each corner post has an attachment fixture disposed at the top to enable selective coupling of the attachment components and accessories in various combinations. When assembled, the primary and secondary attachment components form a framework to which the accessories can be mounted.

The reconfigurable sports training device includes a variety of accessories that can be used alone or in combination with the attachment components. These accessories include, but are not limited to, biased swing arms, various catch net bag accessories, various catch net accessories, a basketball hoop accessory, a speed bag accessory, a treadmill accessory, and a universal rebound board accessory.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
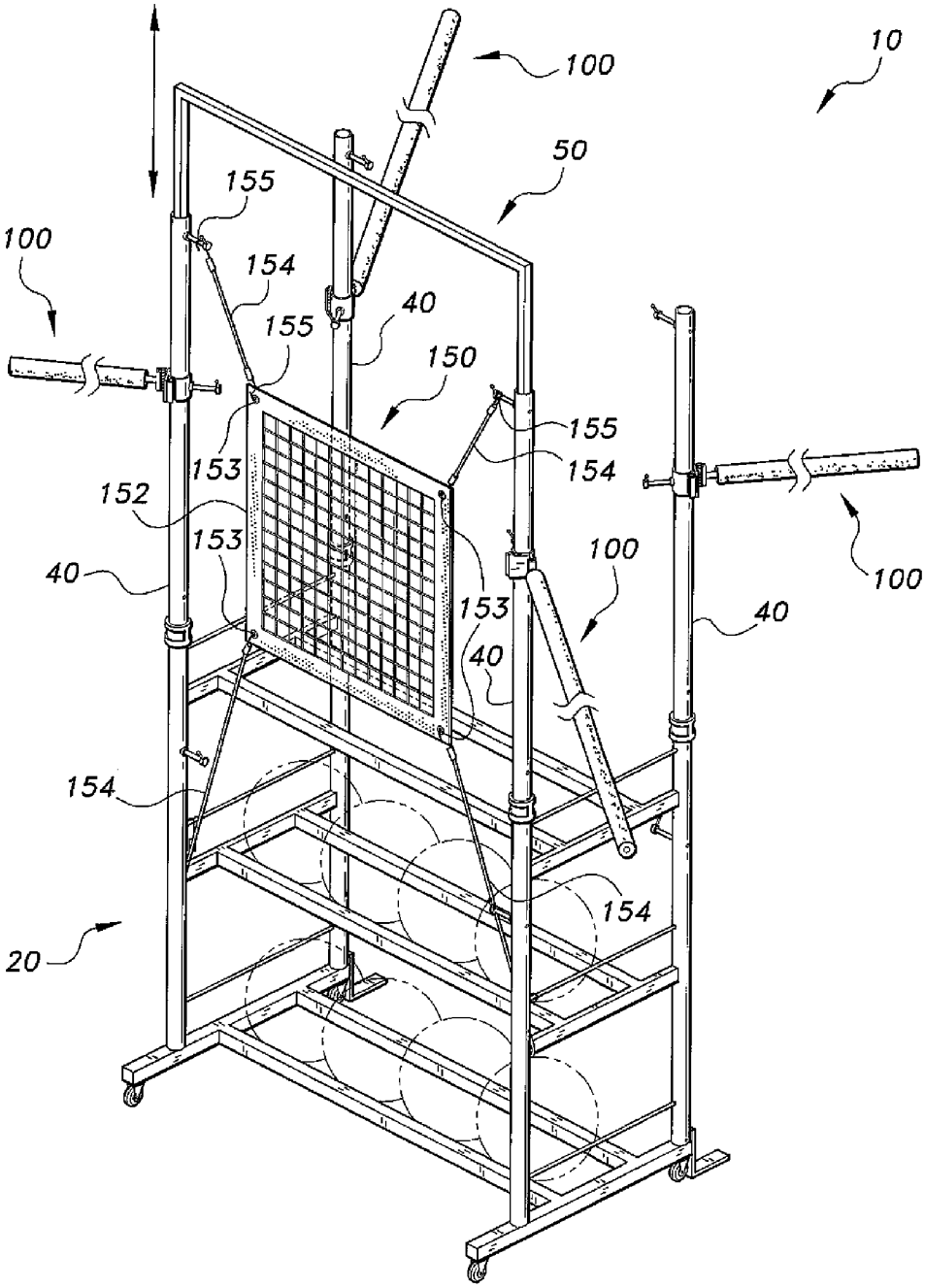
FIG. 1 is a perspective view of a reconfigurable sports training device according to the present invention, the reconfigurable sports training device being assembled in one of many configurations.
Figure 2:
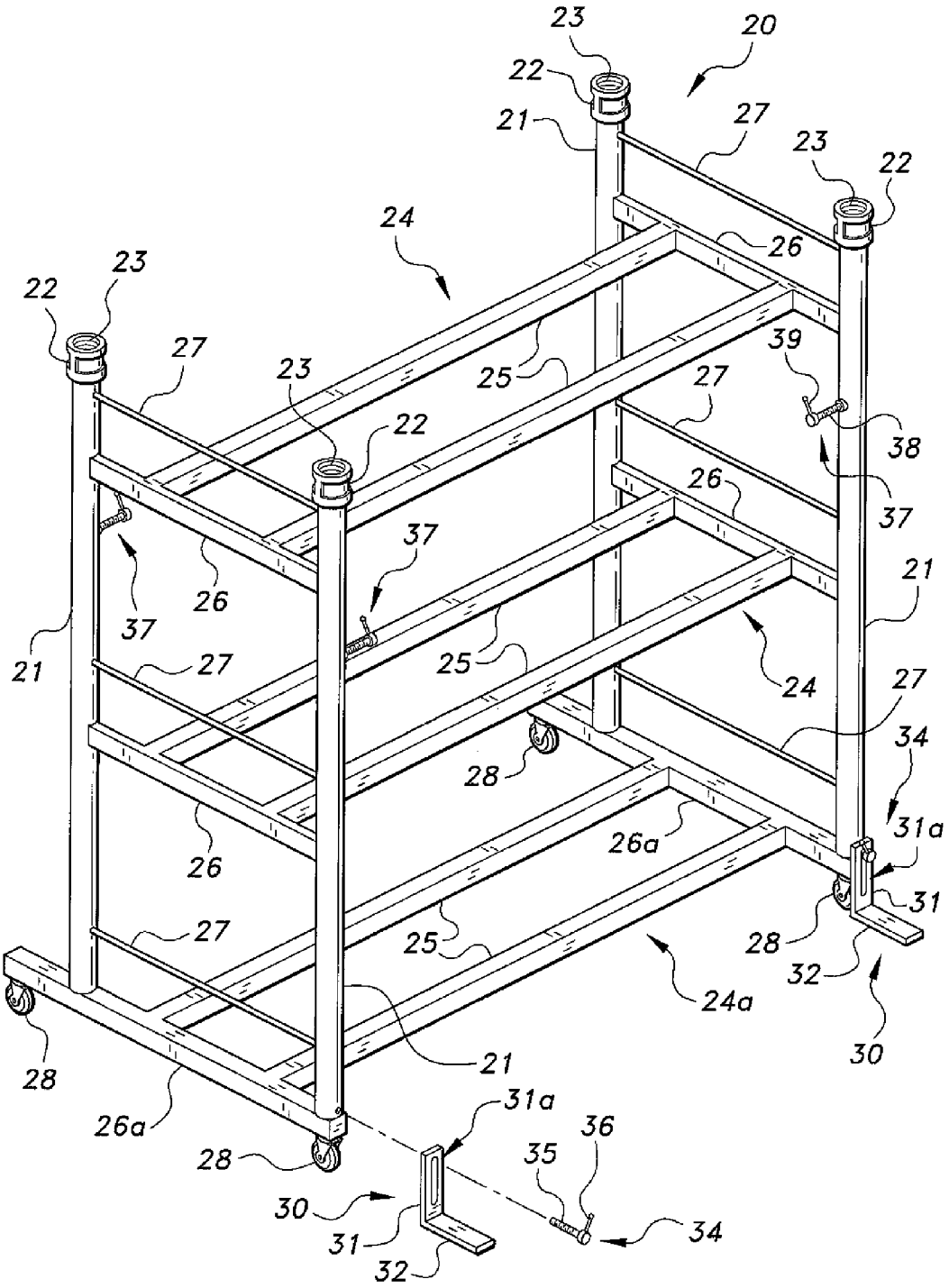
FIG. 2 is a perspective view of a main base frame for a reconfigurable sports training device according to the present invention.

The reconfigurable sports training device, generally referred to in the drawings by the reference number 10, provides various independent and interchangeable components that can be assembled by the user into a variety of desired configurations for training at least one specific sports skill. As best seen in FIGS. 1 and 2, the reconfigurable sports training device 10 includes a main base frame 20 and a plurality of components mountable to the main base frame 20. These components can also be referred to as accessories or attachments.

The main base frame 20 is preferably configured as a movable rack having a substantially rectangular frame that includes four corner posts 21 and at least one shelf 24, 24*a* extending between the corner posts 21 at predefined height intervals. The main base frame 20 can be provided, e.g., with three shelves 24, 24*a*, i.e., a top shelf, a bottom shelf, and a middle shelf. Each shelf 24, 24*a* can be constructed from a pair of spaced, elongate members 25 and a pair of spaced, elongate cross members 26, 26*a* coupled to the respective ends of the elongate members 25 to form the shelf 24, 24*a*, or at least a frame for the shelf 24, 24*a*. The cross members 26, 26*a* are coupled to the corner posts 21 in any conventional manner, such as via welding or fasteners. The space between the elongate members 25 facilitates stable support and storage of athletic balls, such as basketballs, volleyballs, footballs, and the like. The cross members 26, 26*a* provide structural rigidity and stability to the main base frame 20 in order to maintain the overall general rectangular shape. Each shelf 24, 24*a* can also be provided as a solid board or a meshed or net platform with or without a surrounding fence for secure placement and storage of athletic balls and/or other athletic equipment. Additionally, the main base frame 20 can include an elongate stop rod 27 disposed at an elevated position above the level of the respective shelf 24, 24*a* along the length of the corner posts 21, which acts as a stop abutment, preventing any athletic ball from inadvertently rolling off the ends of the shelf 24, 24*a*.

The main base frame 20 includes features that ease transport of the main base frame 20. As best seen in FIG. 2, the bottom shelf 24*a* is different from either of the top and middle shelves 24. The cross members 26*a* are longer than the other cross members 26 such that a portion thereof extends past one of the corner posts 21 to which the cross member 26*a* is attached. This provides a wide base to provide stability to the main base frame 20 when stationary as well as during transport. While the increased length of the cross member 26*a* increases the stability of the main base frame 20, the portion of the cross member 26*a* extending past the corner posts 21 can also be weighted, e.g., a weight can be integrated into that portion of the cross member 26*a*, or the extension of the cross member 26*a* can be constructed with denser or heavier material than the remainder to increase the stabilization effect thereof.

A pair of casters 28 are coupled to the bottom of the cross members 26*a*. The casters 28 allow the user to easily move the main base frame 20 to a desired location and configure the reconfigurable sports training device 10 for a specific desired training regimen. The casters 28 can also be provided with conventional wheel locks in a manner known in the art in order to insure the main base frame 20 remains stationary during use.

While the casters 28 facilitate convenient and easy transport, some configurations of the reconfigurable sports training device 10 may result in a setup that decreases the standing stability of the reconfigurable sports training device 10, for example, due to the manner in which the components or accessories are coupled to the main base frame 20. For example, a relatively tall crossbar mounted to one side of the main base frame 20 can potentially cause the configured device to lean to one side due to a potential imbalance in the center of mass. In order to prevent such occurrences, the reconfigurable sports training device 10 can be provided with at least one brace 30 that can be detachably mounted to a corresponding corner post 21. In an embodiment, the brace 30 can be provided as an L-shaped bracket having one leg member 31 mounted along the corresponding corner post 21 and the other orthogonal leg member 32 extending outward therefrom to rest upon the floor or ground. When assembled, the orthogonal leg member 32 prevents and counteracts any tendency of a user-configured sports device to tilt in the direction of the extension of the leg member 32. The coupling of the brace 30 can be facilitated by a locking mechanism 34. The locking mechanism 34 can be provided as a threaded clamping bolt 35 with a handle 36 extending orthogonally from one end for ease of operation. The one leg member 31 can also include an elongated slot 31*a* extending along the length of the one leg member 31. The slot 31*a* enables selective vertical adjustments of the brace 30 to a desired or preferred height and fixed in position by the locking mechanism 34.

The main base frame 20 functions as a platform on which various components can be attached to configure the reconfigurable sports training device 10 into a user-defined or configured device for training or conditioning desired skills. In order to facilitate the selective attachments, each corner post 21 is preferably constructed from an elongate, hollow circular tube having an attachment or mounting fixture or socket 22 disposed at the top thereof. Each attachment fixture 22 is preferably provided with internal threads 23 for securely mounting various components therein.

Each corner post 21 can also be provided with at least one locking mechanism 37 extending from a medial portion of the corresponding corner post 21. Each locking mechanism 37 locks or fixes the relative position of a component or member telescopically mounted inside the corner post 21. Each locking mechanism 37 may be substantially similar to the locking mechanism 34, and includes an elongate, threaded bolt 38 that threads into the corresponding corner post 21 in order to clamp the component or member inserted therein. A handle 39 extends orthogonally from an end of each locking mechanism 37 to facilitate easy manual rotation of the locking mechanism 37 between locked and unlocked positions. The handle 39 can also serve as a mounting hook that provides attachment points for mounting components requiring hook connections, for example certain catch nets that need to be mounted in a stretched condition.

Figure 3A:
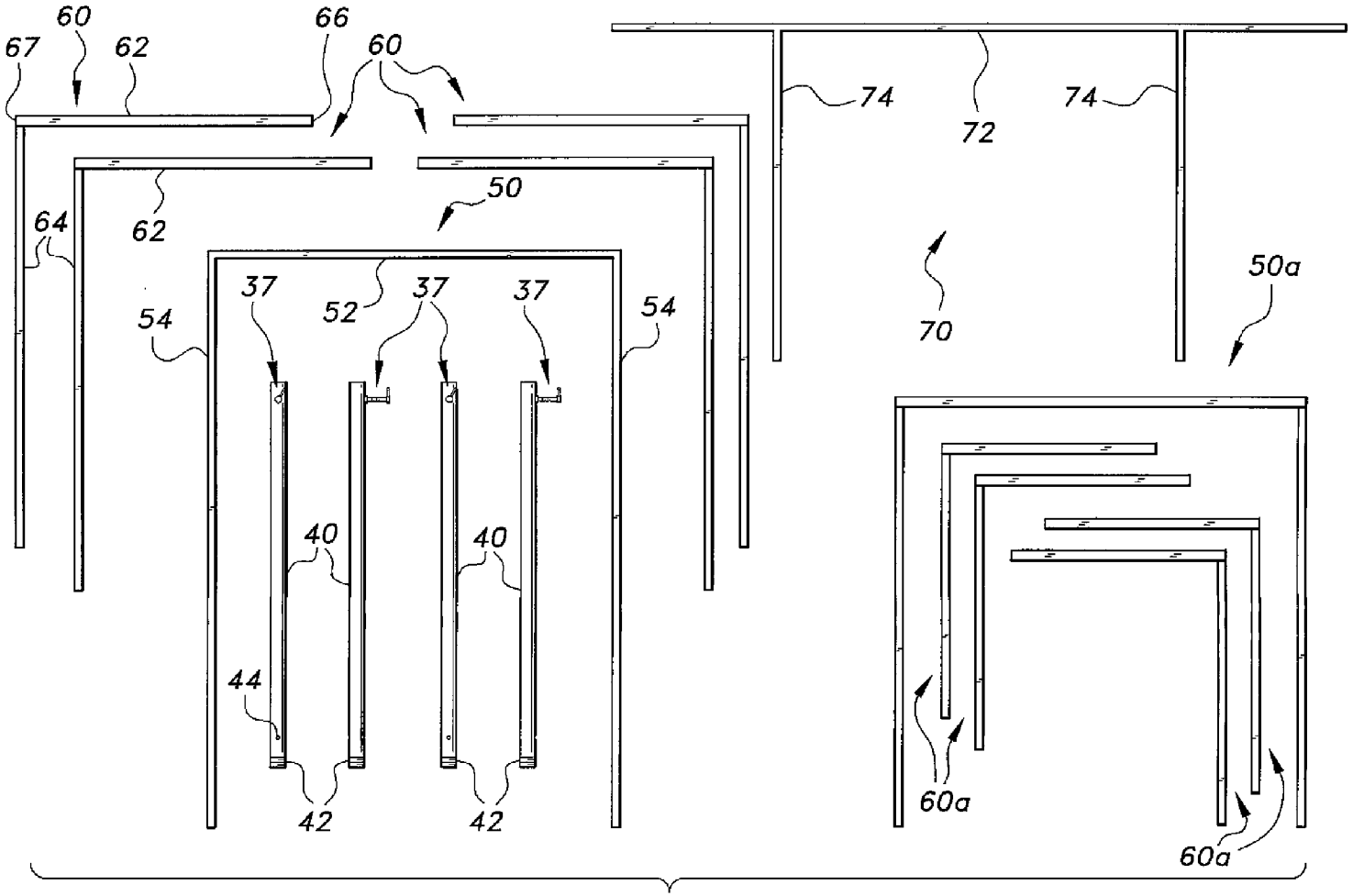
FIG. 3A is a plan view of a plurality of primary attachment components for the reconfigurable sports training device according to the present invention.

The reconfigurable sports training device 10 includes a variety of primary attachment components that can be connected to the main base frame 20 in various combinations to facilitate attachment of a variety of accessories for the desired configuration. As best seen in FIG. 3A, the primary attachment components includes at least one vertical extender support post 40, at least one U-shaped horizontal beam or bar 50, at least one L-shaped upright beam or bar 60, and a T- or Pi-bar or beam 70. These can be provided as parts of a kit and in various dimensions.

Each vertical extender support post 40 is preferably configured as an elongate, hollow or solid cylindrical bar or beam. The vertical extender support post 40 includes a threaded end 42 for securely attaching the vertical extender support post 40 to the mounting fixture 22 of a respective corner post 21. Each vertical extender support post 40 can also be provided with at least one hole 44, preferably threaded, near the opposite ends that acts as attachment points for pins, hooks, bolts, and the like. An unthreaded hole 44 can be used as a receptacle for an elongated tool or implement, such as a screwdriver, bar, or beam, to be selectively inserted therein. The tool or implement functions as a leveraging element for the user to torque or rotate the vertical extender support post 40 during the process of mounting or removing the vertical extender support post 40 from the corresponding mounting fixture 22. Once seated, the vertical extender support post 40 serves as a framework for adjustably attaching the various components or accessories to be described at various adjusted heights. Each vertical extender support post 40 can also be provided with another locking mechanism 37 to clamp adjusted positions of components inserted therein, especially for various attachment components insertably mounted therein. While the threaded connection between the threaded end 42 of the vertical component and the corresponding mounting fixture 22 provides a very secure engagement therebetween, the reconfigurable sports training device 10 can be provided with other secure connecting means, such as locking male-female connectors, clamp locks, bolt locks, and the like. Moreover, the vertical extender support posts 40 can be provided in other shapes and forms, such as elongate square bars or tubes, elongate rectangular bars or tubes, I-beams, and beams or bars with various cross-sectional geometric shapes that can accommodate attachment of the accessories described below.

The U-shaped horizontal bar 50 is preferably configured as a bar that is bent or welded into a U-shape, having a horizontal member 52 and leg members 54 extending orthogonally from the ends of the horizontal member 52. This configuration permits each leg member 54 of the U-shaped horizontal bar 50 to be slidably mounted into a respective vertical extender support post 40, corner post 21 or any other hollow component with a large enough opening to accommodate telescopic insertion of a leg member 54. For most applications, the U-shaped horizontal bar 50 generally mounts to a pair of spaced vertical extender support posts 40 to permit nets and other types of sports accessories to be hung from the horizontal member 52 and/or attached to the horizontal member 52 and/or leg members 54. The length of the leg members 54 provides sufficient span to adjust the relative height of the U-shaped horizontal beam 50 with respect to the component on which the U-shaped horizontal beam 50 is mounted. When installed in the vertical extender support post 40, the adjusted height can be fixed with another locking mechanism 37 via a corresponding hole 44. Similarly, the adjusted height of the U-shaped horizontal bar 50 can be fixed by the locking mechanisms 37 on the respective corner posts 21 when installed therein. The U-shaped horizontal beam 50 can be constructed from hollow or solid bar stock and formed into the U-shape from a single or multiple pieces.

The L-shaped upright bar 60 is substantially similar to the U-shaped horizontal bar 50 in that each is preferably configured as a bar bent or welded into the L-shape, having a vertical member 64 and a horizontal member 62 extending orthogonally from one end of the vertical member 64. Just as with the U-shaped horizontal bar 50, the L-shaped upright bar 60 can be slidably mounted to a respective vertical extender support post 40 and/or the respective corner post 21. A locking mechanism 37 fixes the adjusted height. The L-shaped upright bar 60 is preferably constructed from round or square tubes so that the ends thereof can include an opening, such as the openings 66, 67. The openings 66, 67 can be used to insertably mount other components therein.

The T-bar or Pi-bar 70 is generally used to hang accessories and includes an elongate horizontal member 72 and a pair of spaced mount posts or pins 74 extending orthogonally therefrom. The designations "T" and "Pi" reference the general shape of bar 70 to the letter "T" and the Greek letter "Π" in plan view, as shown in FIG. 3A. The mount posts 74 facilitate mounting of the T-bar 70 onto any of the attachment components with available openings for the same. An example of such a configuration is to mount the T-bar 70 into the openings 66 at the ends of the L-shaped upright bars 60 to form an overhang from which other accessories can hang or connect.

As mentioned previously, the primary attachment components can be provided in various sizes and/or lengths, especially since it is contemplated that the primary attachment components will be the basic and most widely utilized by the user. Due to the envisioned frequent and constant use, FIG. 3A also shows at least one U-shaped horizontal beam or bar 50*a* and at least one L-shaped upright beam or bar 60*a* that are smaller dimensioned, and which can be provided as a separate kit or in combination with the abovementioned components, and these smaller components can be combined with the larger components to form a user-desired configuration.

Figure 3B:
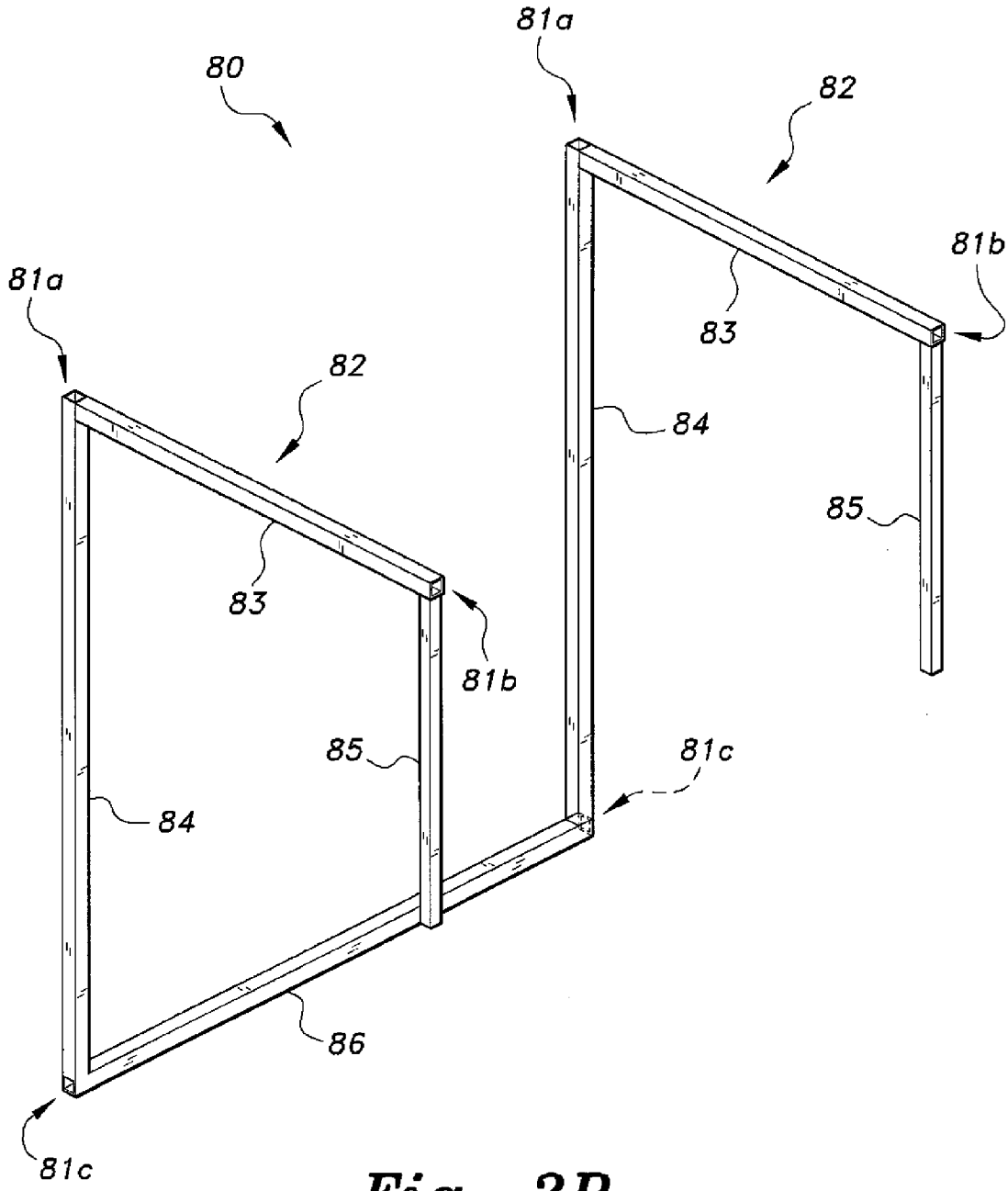
FIG. 3B is a perspective view of a first sub-frame for a reconfigurable sports training device according to the present invention.

In addition to the primary attachment components, the reconfigurable sports training device 10 also includes a plurality of secondary or auxiliary attachment components to further expand the potential user-defined configurations. An example of an auxiliary attachment component is shown in FIG. 3B. As shown, this auxiliary attachment component is a first sub-frame 80 generally adapted for forming a rectangular frame to hang a net at an offset position from the front or back of the main base frame 20. The first sub-frame 80 includes a pair of spaced, substantially hook-shaped upright beams or bars 82 connected to each other by a cross member 86. Each hook-shaped upright bar 82 includes an elongate horizontal member 83, an elongate vertical member 84 extending orthogonally from one end of the horizontal member 83, and an elongate insert member 85 spaced parallel to the vertical member 84 and depending from the opposite end of the horizontal member 83. The insert members 85 are preferably shorter in length than the vertical members 84 and configured to be inserted into corresponding holes or openings in the corner posts 21, or in any of the primary attachment components. The length of the insert members 85 should be sufficiently long enough to provide a securely mounted engagement with the main frame base 20 and be secured by a locking mechanism 37. When assembled in this manner, the vertical members 84 and the cross member 86 form a U-shaped partial frame disposed at an offset position from the side of the main base frame 20 to which the first sub-frame 80 is mounted, and the cross member 86 acts as a base that supports the first sub-frame 80 on a surface. Moreover, the first sub-frame 80 can serve as a supplementary brace for the main base frame 20. The first sub-frame 80 is preferably constructed from square tubes, and various corners thereof can be left unobstructed to define mounting holes/openings 81*a*, 81*b*, 81*c* for selective insertion of other components. In one configuration, once the first sub-frame 80 has been properly installed, one of the U-shaped horizontal bars 50, 50*a* can be slidably mounted into the mounting holes 81*a*, thereby forming the top and bottom halves of a vertical, rectangular frame for attaching various nets and other accessories. Although not shown, selected members 83, 84, 85 can be provided with a hole and a corresponding locking mechanism 37 to fix relative positions of components inserted therein.

Figure 3C:
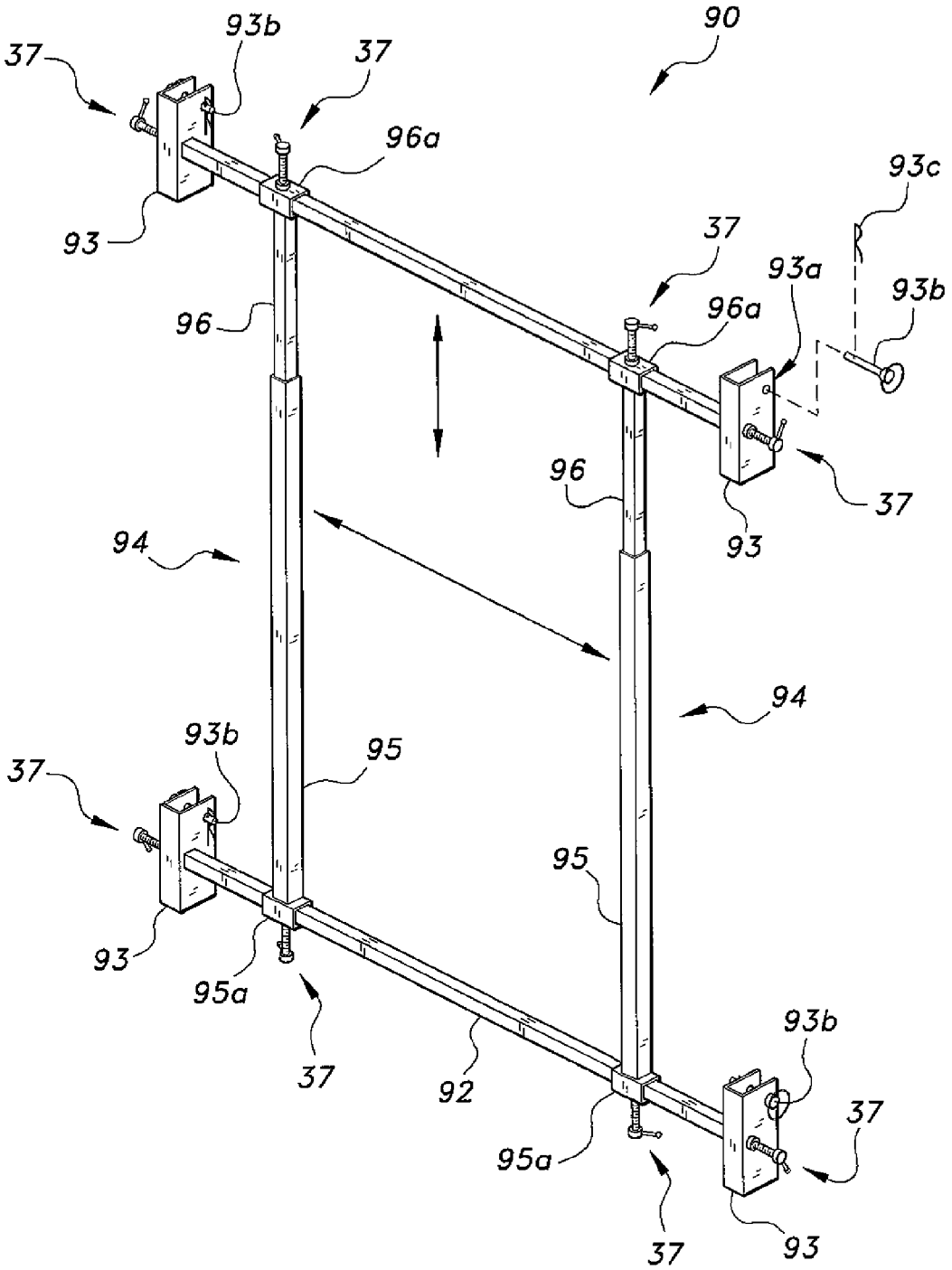
FIG. 3C is a perspective view of a second sub-frame for a reconfigurable sports training device according to the present invention.

Another secondary or auxiliary attachment component is shown in FIG. 3C. This auxiliary attachment component is an adjustable second sub-frame 90 constructed so as to provide a variety of adjustable, user-defined rectangular frame configurations for attaching accessories thereon. The second sub-frame 90 includes a pair of spaced, elongate horizontal bars 92 defining opposing top and bottom sides of the second sub-frame 90. Each horizontal bar 92 is preferably the same predetermined length, and the ends of the horizontal bars 92 each include a mounting bracket 93 disposed perpendicularly thereon. The spacing of the mounting brackets 93 is preferably the same width as the spacing of the vertical extender support posts 40 when the vertical extender support posts 40 are mounted to the main base frame 20. Similarly, this spacing is also substantially the same as the lengthwise spacing between a pair of corner posts 21, the leg members 54 of the U-shaped horizontal attachment bar 50, and the vertical members 84 of the first sub-frame 80, in order to permit proper and interchangeable mounting of the second sub-frame 90 to those elements.

Each mounting bracket 93 can be constructed as an open sleeve or a channel that easily slides over a vertically oriented member. As best seen in FIG. 3C, the mounting bracket 93 is configured as a relatively short C-channel. Once the relative heights of the horizontal bars 92 have been adjusted to the desired heights, the adjusted position can be fixed by manual operation of respective locking mechanisms 37 coupled to each mounting bracket 93. The sidewalls of the C-channel can also be provided with aligned through holes 93*a* near the distal ends thereof, and a locking pin 93*b* can be selectively inserted through the through holes 93*a* on each mounting bracket 93 and secured by a cotter pin 93*c* to trap the vertically oriented member within the C-channel when the mounting bracket 93 is mounted to the vertically oriented member. In other words, the locking pin 93*b* locks the mounting bracket 93 behind the vertically oriented member. This configuration substantially prevents accidental disengagement of the mounting bracket 93 from the vertically oriented member. Thus, the mounting bracket 93 will be secured to the vertically oriented member at two points by the associated locking mechanism 37 and the locking pin 93*b*.

The second sub-frame 90 also includes at least a pair of adjustable vertical bars 94 slidably coupled to the horizontal bars 92. Each vertical bar 94 is preferably a telescoping structure having a first telescoping member 95 and a second telescoping member 96 slidably mounted in the first telescoping member 95. One end of the first telescoping member 95, or one end of the adjustable vertical bar 94, includes a first follower 95*a* arranged perpendicular to the first telescoping member 95, and the first follower 95*a* is slidably mounted to one of the horizontal bars 92. Additionally, one end of the second telescoping member 96, or opposite end of the adjustable vertical bar 94, includes a similarly arranged second follower 96*a* mounted to the other horizontal bar 92. Each first follower 95*a* and second follower 96*a* is preferably constructed as a relatively short sleeve with a cross-sectional shape corresponding to the cross-sectional shape of the horizontal bar 92. The slidable mounting of the first and second followers 95*a*, 96*a* enables each vertical bar 94 to be adjusted laterally along the length of the horizontal bars 92, and the adjusted position can be fixed by locking mechanisms 37 coupled to the first and second followers 95*a*, 96*a*. The matching cross-sectional shape eases movement of the first and second followers 95*a*, 96*a* along the horizontal bars 92. In the embodiment shown in FIG. 3C, both the horizontal bars 92 and the vertical bars 94 are preferably constructed from square tubes or pipes, and the first and second followers 95*a*, 96*a* are configured as square-shaped hollow sleeves. It is noted, however, that the horizontal bars 92, the vertical bars 94, and the associated mounting brackets 93 and followers 95*a*, 96*a* can be provided in various shapes, such as round, rectangular, hexagonal, octagonal, and other geometrically shaped tubes or solid bars.

It can be seen from FIG. 3C and the above construction that the second sub-frame 90 provides features enabling a plurality of user-defined configurations that define the shape and size of a rectangular opening. For example, the relative heights of the horizontal bars 92 can be easily adjusted to shorten or lengthen the rectangular opening between the horizontal bars 92 and vertical bars 94, and the telescoping nature of the vertical bars 94 facilitates self-adjustment of the vertical bars 94 to compensate for the height adjustment of the horizontal bars 92. The slidable mounting of the vertical bars 94 enables the vertical bars 94 to be easily adjusted laterally to narrow or widen the rectangular opening. The many possible adjustments afforded by the second sub-frame 90 provide the user with a variety of choices for the opening size to accommodate the accessory being attached thereto and/or the specific skills targeted for training, e.g., a catch net designed to catch baseball pitches or throws that has an opening that can be increased or decreased in size to train for accuracy of the throws.

Figure 4A:
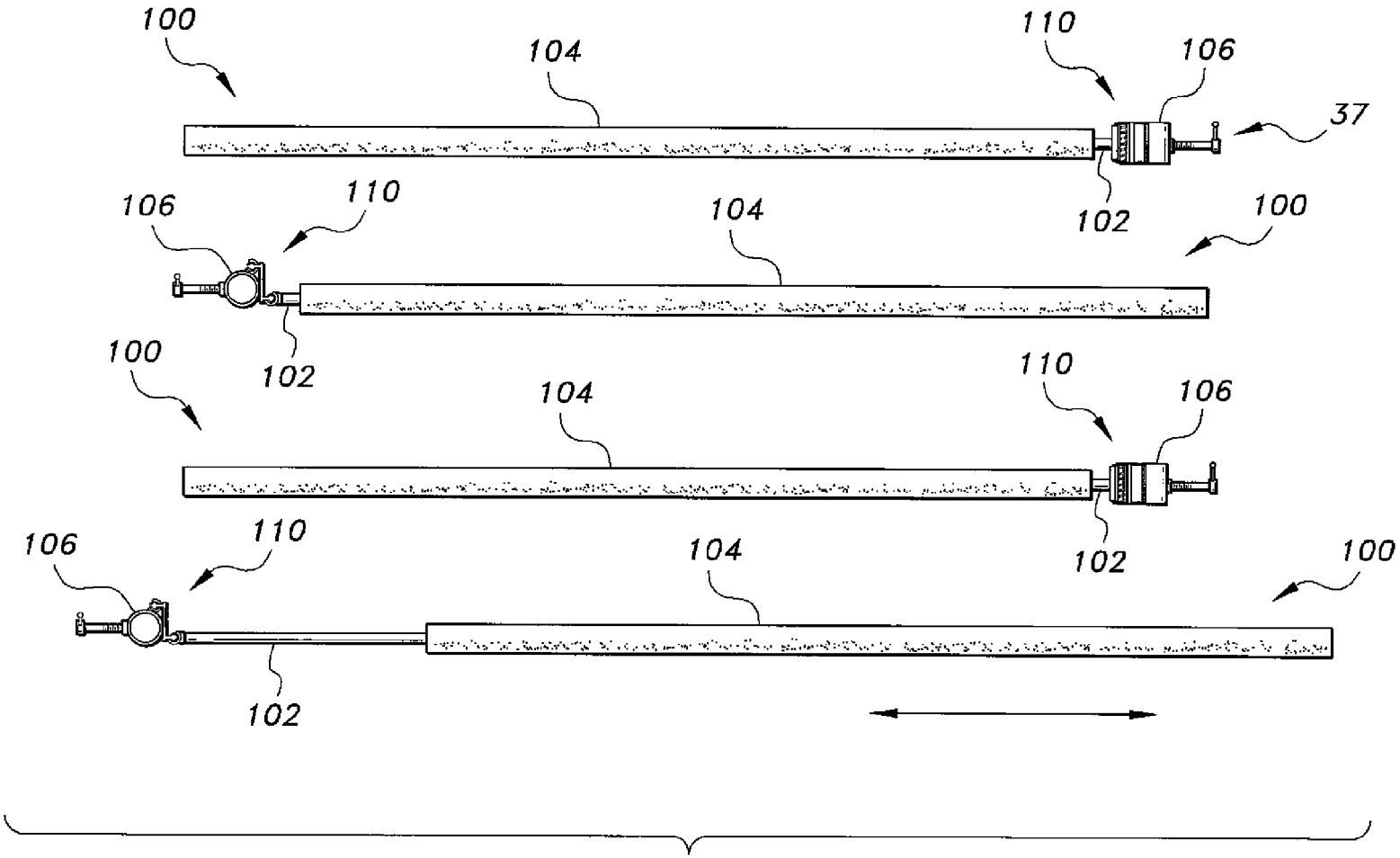
FIG. 4A is a plan view of a plurality of swing arms for a reconfigurable sports training device according to the present invention.
Figure 4B:
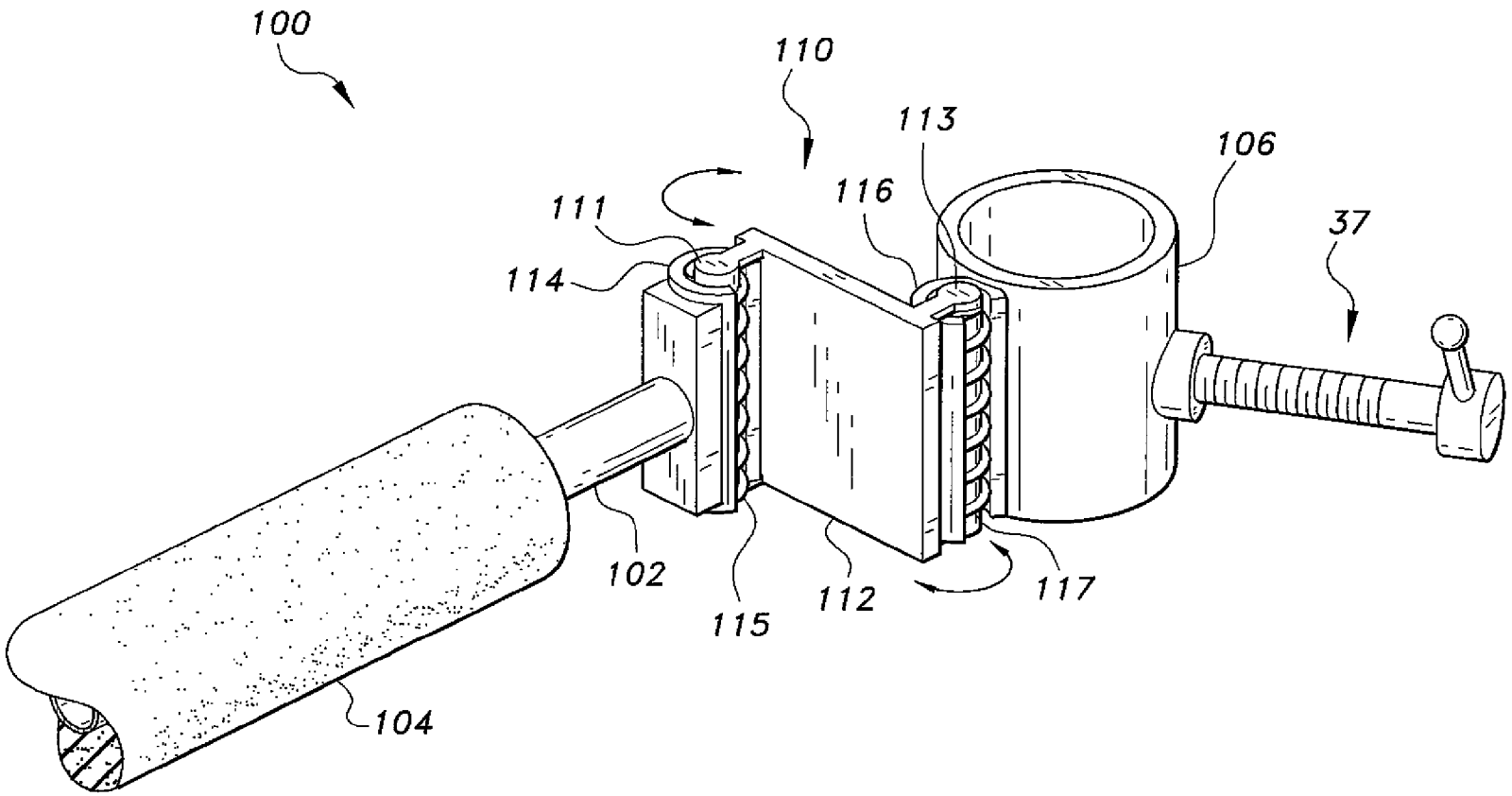
FIG. 4B is a detailed perspective view of a biased hinge assembly used in the swing arm of FIG. 4A.

The reconfigurable sports training device 10 includes a plurality of accessories designed to train certain sports and/or skills associated with a particular sport. One of the accessories is shown in FIGS. 4A and 4B which discloses one or more biased swing arms 100. The swing arms 100 are a type of cross-training sports accessory, i.e., an accessory that can be used in multiple sports disciplines. Each swing arm 100 includes an elongate telescoping bar coupled to a biased hinge assembly 110 that is integral with or attached to a mounting bracket 106. The mounting bracket 106 is preferably a circular sleeve configured to slidably mount over the vertical extender support post 40 at user-defined or user-adjusted heights. The adjusted position is fixed by a locking mechanism 37 coupled to the corresponding mounting bracket 106.

The elongate telescoping bar simulates an elongate obstruction, such as an opponent's laterally outstretched arm. In general use, once the desired height has been set, users and players can practice their ducking and weaving skills past the elongate bar as they dribble a basketball or carry a football. The swing arm 100 can also be configured so that the telescoping bar extends in other directions besides horizontal, so long as the mounting bracket 106 can be properly mounted to accommodate different orientations. Each elongate telescoping bar includes an elongate inner rod 102 of fixed length and an elongate, extendable outer sleeve 104 slidably mounted to the inner rod 102. Selective retraction or extension of the outer sleeve 104 with respect to the inner rod 102 permits the elongate telescoping bar to extend or retract between minimum and maximum lengths thereof. Any sports training device must also be limited in its capacity to induce potential injury for the safety and protection of the participant. In order to minimize such potential accidents, the outer sleeve 104 can be provided as a cushioned sleeve covered with resilient material. Such resilient materials can include, but are not limited to, foam, sports pads, neoprene, rubber, and the like.

Further safe operation is provided by the biased hinge assembly 110. During use, when the user pushes against the telescoping bar, either intentionally or unintentionally, during the course of training activity, the telescoping bar will deflect and swing away from the direction of the push, and then return to the original position after subsequent release due to the biased hinge assembly 110. The hinge assembly 110 is preferably a double-acting hinge and includes a hinge bracket or plate 112 with an integral first hinge pin 111 and an integral second hinge pin 113 extending from opposite ends of the hinge bracket 112. The inner rod 102 is connected to a first knuckle 114, which, in turn, is pivotally coupled to the first hinge pin 111. A first spring 115, such as a coil spring, can be operatively coupled between the first hinge pin 111 and the first knuckle 114 in order to permit pivotal or swinging movement of the elongate telescoping bar about the first hinge pin 111, yet the bias of the first spring 115 insures that the telescoping bar returns to the normal or original position after deflection. The second hinge pin 113 is pivotally mounted inside the second knuckle 116, and a second spring 117 is also coupled between the second hinge 113 and the second knuckle 116 to provide a similar biasing function as the first spring 115. The biased connections are preferably configured so that each is biased in the opposite direction from the other. As a result, both the first and second springs 115, 117 act in concert to return the swing arm 100 back to the original position during use.

The swing arms 100 also have additional functions besides acting as a simulated obstacle. For example, a pair of swing arms 100 mounted on respective vertical extender support posts 40 can be used as a measuring device for measuring the wingspan of a player/user. In this configuration, a pair of vertical extender support posts 40 is mounted to a respective pair of mounting fixtures 22 on one side of the main base frame 20. Each swing arm 100 is mounted to a respective vertical extender support post 40 and adjusted so that both swing arms 100 are level and at shoulder height of the player to be measured. The swing arms 100 should also be extending in a straight line substantially coplanar with the mounted side of the main base frame 20. If required, the length of each swing arm 100 can be selectively adjusted by extending or retracting the outer sleeve 104. Once the reconfigurable sports training device 10 has been configured in this manner, the player stands between the vertical extender support posts 40 and stretches his arms out along the length of the respective swing arms 100. At this point, the player/user can perform self-measurements by marking or noting the position of the tips of their fingers with respect to each swing arm 100 or utilize another person to make those measurements.

Figure 5:
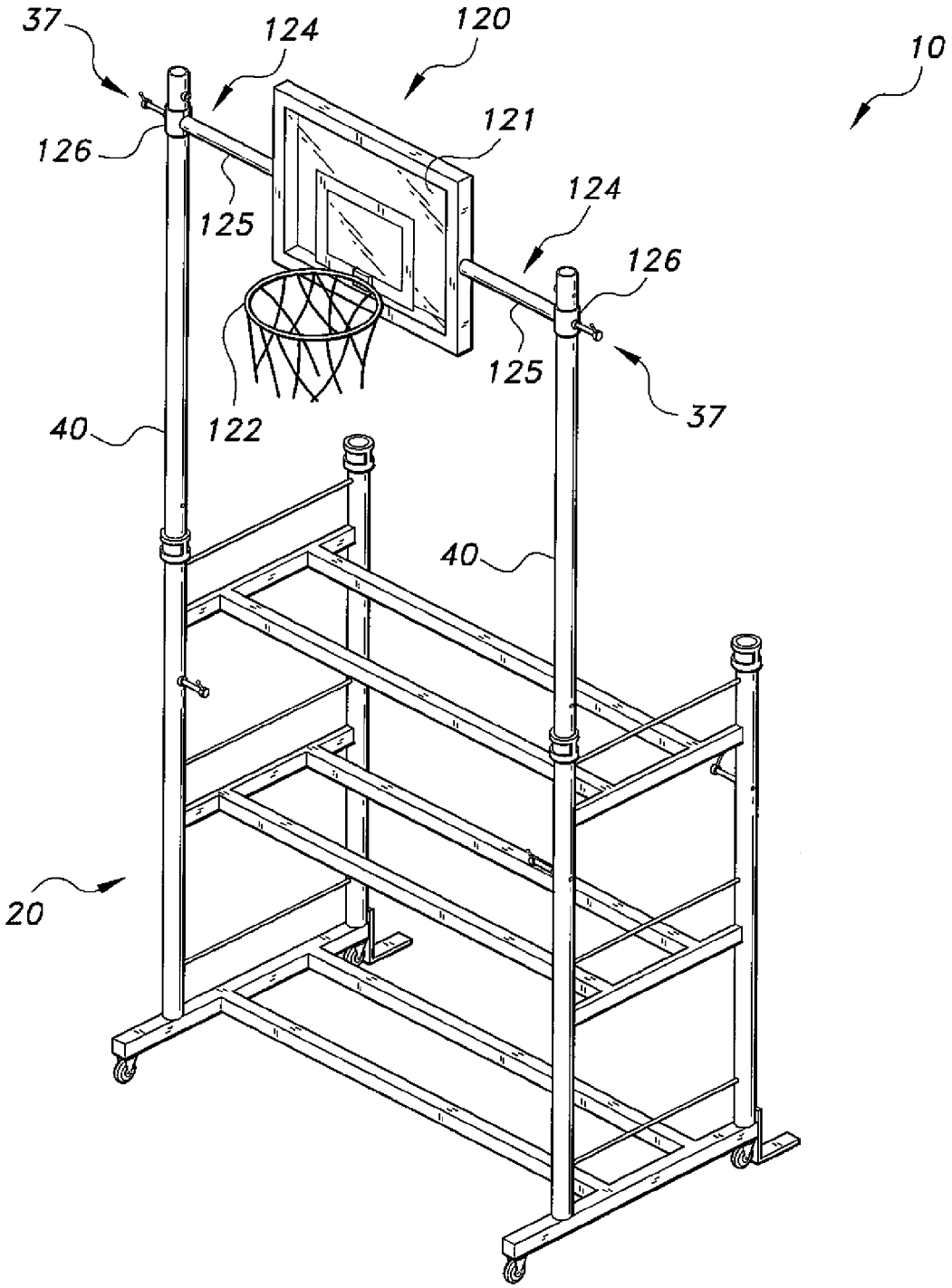
FIG. 5 is a perspective view of another configuration of the reconfigurable sports training device according to the present invention, showing the use of a basketball hoop accessory.

It is contemplated that some types of accessories will be used more often or be more popular. One of these types of accessories is shown in FIG. 5. The accessory is a basketball hoop accessory 120 that can be adjustably mounted between a pair of vertical extender support posts 40. The basketball hoop accessory 120 includes a backboard 121, a hoop 122 extending from the backboard 121, and a mounting assembly 124 for mounting the basketball hoop accessory 120 onto the main base frame 20. The mounting assembly 124 includes a pair of mounting posts 125 extending from opposing sides of the backboard 121. A mounting bracket 126 is fixed to the distal end of each mounting post 125. Each mounting bracket 126 is preferably a circular sleeve dimensioned to slidably mount over a corresponding vertical extender support post 40. Once the desired height has been set, the adjusted position can be fixed by a locking mechanism 37 disposed on each mounting bracket 126. Due to the length of the vertical extender support post 40, the height of the basketball hoop accessory 120 can be adjusted widely to accommodate all ages, heights, and capabilities of players.

Figure 6:
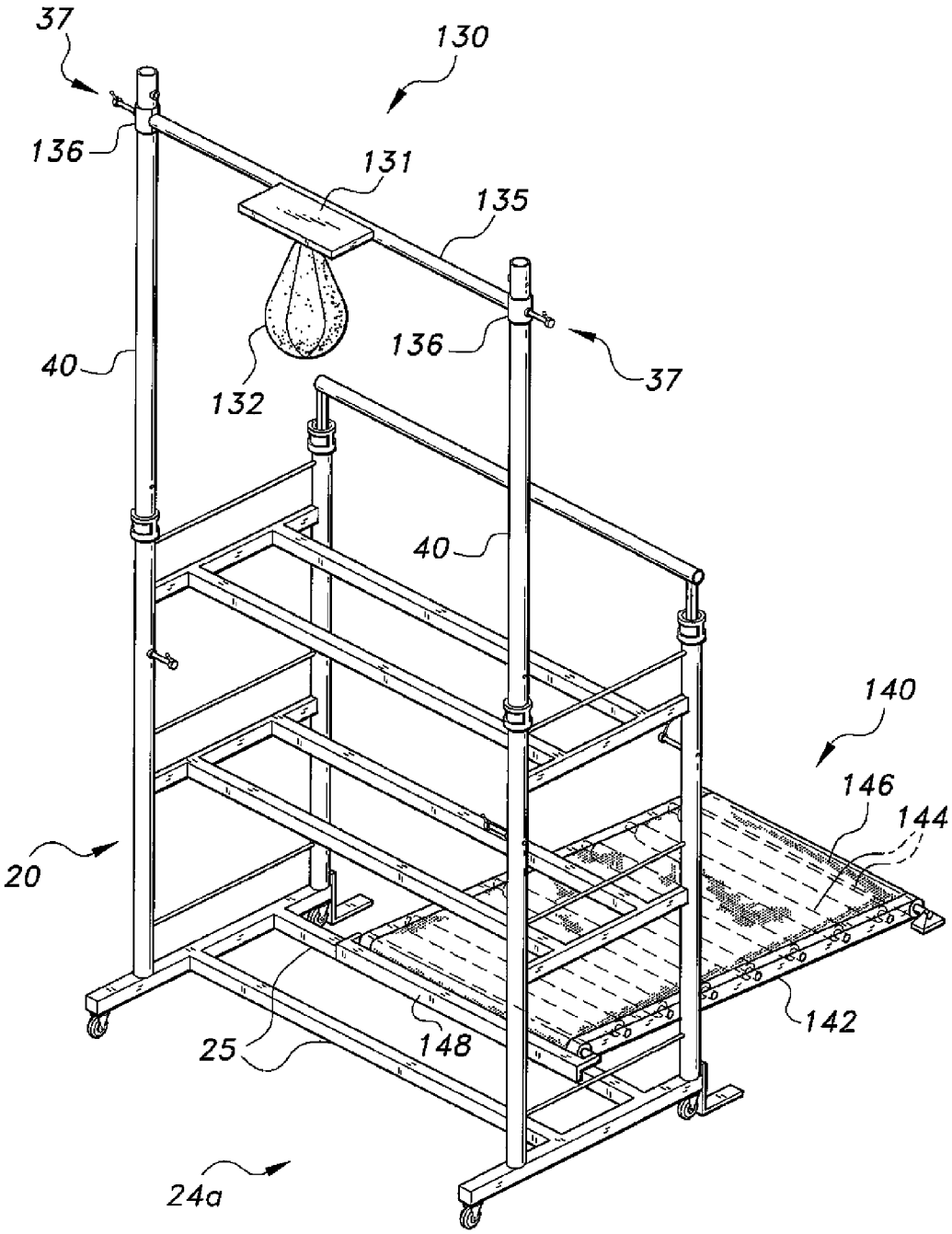
FIG. 6 is a perspective view of a further configuration of the reconfigurable sports training device according to the present invention, showing the use of a speed bag accessory and a treadmill accessory for physical conditioning.

FIG. 6 shows a couple of other accessories designed for physical conditioning. The first of these accessories is a speed bag accessory 130 configured to be mounted on a pair of vertical extender support posts 40 in substantially the same manner as the basketball hoop accessory 120. The speed bag accessory 130 includes an elongate mounting bar or beam 135 having a mounting bracket 136 disposed at opposite ends of the elongate bar 135. The mounting brackets 136 are preferably the same as the mounting brackets 126. A speed bag rebound board 131 extends from the elongate mounting bar 135 so that one of the flat faces or surfaces of the speed bag rebound board 131 is parallel to the floor. A speed bag or ball 132 preferably hangs from the geometric center of the rebound board 131 to maximize the surface area for the speed bag 132 to bounce off of during use. It is noted that the speed bag rebound board 131 can be provided in a variety of shapes besides the square or rectangle shape shown in the drawings. Moreover, the speed bag rebound board 131 can span anywhere from a relatively small portion (as shown) of the elongate mounting bar 135 to the full extent or more of the elongate bar 135. During assembly, the adjusted height of the speed bag accessory 130 can be fixed by a locking mechanism 37 coupled to the respective mounting brackets 136. The main base frame 20 provides the stability necessary to endure the impact forces during use. The speed bag accessory 130 can be used to help the user improve hand-eye coordination, reflexes, endurance, and cardiovascular conditioning.

The second of these accessories is a treadmill accessory 140. The treadmill accessory 140 includes an elongate treadmill base 142 having a plurality of rollers 144 rotatably mounted thereon. An endless treadmill belt 146 winds around rollers 144, which forms the moveable platform for the user to run in place. One end of the treadmill base 142 includes an attachment hook bracket 148 to hook over one of the elongate members 25 on the bottom shelf 24*a*. When assembled, the hooked connection places the treadmill accessory 140 at an angled or inclined position with respect to the floor. The incline increases the effort required of the user to keep a desired pace. In order to increase the intensity of the workout, the treadmill accessory 140 can be provided with adjustable tensioning means (not shown) that can retard rotation of the rollers 144 or tension the treadmill belt 146 or both, thus forcing the user to expend more effort during the exercise. Moreover, the treadmill accessory 140 can be provided with additional features such as a motor and an associated control (not shown) for the user to selectively control and set the desired pace and/or a lap/mileage counter.

A common accessory to be used in the reconfigurable sports training device 10 includes a variety of nets. Examples of these nets can be seen in the various configurations shown in FIGS. 1, 7, and 8. One of the nets is a rebound net accessory 150, shown in FIG. 1. The rebound net accessory 150 is configured to be stretched when mounted to provide enough tension to bounce a ball back to the user when the ball is thrown against the rebound net accessory 150. The rebound net accessory 150 includes a substantially rectangular reinforced netting 152 with holes 153 at the corners thereof and a plurality of resilient and elastic ropes 154 with connectors 155 at opposite ends of each rope 154. The connectors 155 are preferably hooks for easy operation of connecting the ends of the ropes 154. However, other types of connectors, such as male and female connectors, snap-fit fasteners, hook and loop fasteners, ties, and the like and/or combinations thereof can also be used to enable the desired connections. The holes 153 provide openings for hooking one of the connectors 155 of the elastic ropes 154 during the mounting process. Due to the substantial tension that the netting 152 will experience during use, the holes 153 are preferably reinforced with grommets or the like to prevent potential tearing of the netting 152. The opposite connector 155 of each rope 154 can be connected to the vertical extender support posts 40 or the corner posts 21 at the respective locking mechanisms 37, the holes therein, or onto various members of the main base frame 20.

Figure 7:
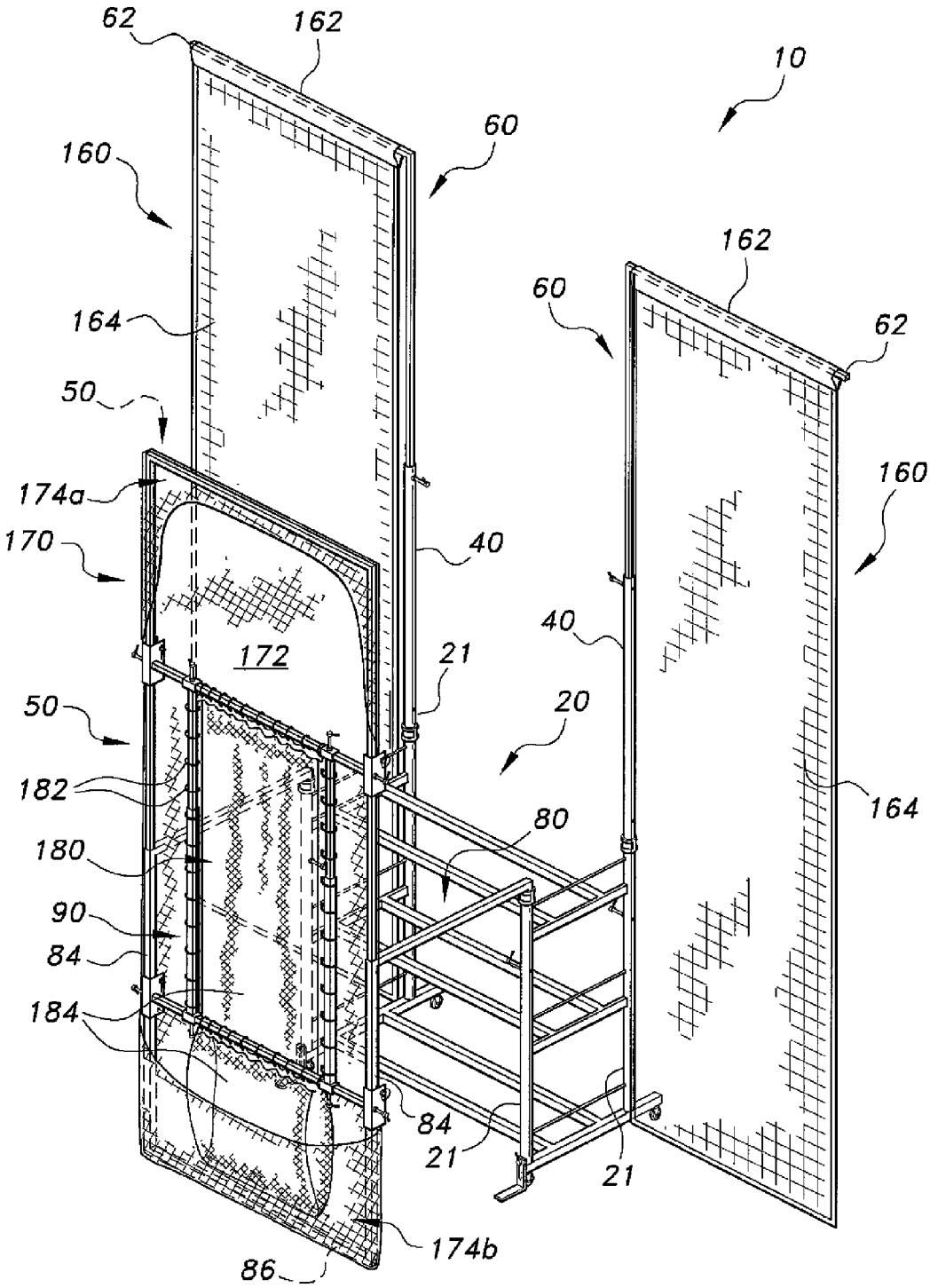
FIG. 7 is a perspective view of yet another configuration of the reconfigurable sports training device according to the present invention, showing the use of various net accessories and primary and secondary attachment components.

Other net accessories include various nets configured to hang from or attach to the primary and secondary attachment components, as shown in FIG. 7. The configuration shown in FIG. 7 is assembled with various net accessories in combination with a variety of primary and secondary attachment components. This configuration is designed to train the user's throwing or hitting/striking accuracy, e.g., as in baseball, softball, or tennis. The various nets serve to provide a target for the thrown or struck balls as well as to catch or retard balls or objects that stray off-target.

As shown in the configuration of FIG. 7, a pair of elongate, hanging catch net accessories 160 hang from respective L-shaped upright bars 60, the L-shaped upright bars 60 being one of the primary attachment components. The hanging catch net accessories 160 are telescopically mounted to respective vertical extender posts 40. Each hanging catch net accessory 160 includes a hanging sleeve 162 and an elongate netting 164. The hanging sleeve 162 can be constructed as an elongate strip or flap of material folded to form a sleeve for slidably mounting over the horizontal member 62 of the L-shaped upright bar 60. Alternatively, the strip of material can include fasteners, such as hook and loop fasteners, snap-fit fasteners, and the like, disposed on the elongate edges of the strip to selectively form the sleeve shape in order to mount the hanging catch net accessory 160 onto the horizontal member 62. The bottom of the elongate netting 164 can also include a similar fastener to enable anchoring a near edge of the elongate netting 164, which can be selectively attached to one of the corner posts 21 as required or needed. If configured in this manner, each elongate netting 164 will be secured on two sides, the top and one elongate side edge.

The remaining net accessories in FIG. 7 further showcase the manner in which several different components and net accessories can be combined to form a major feature of a training device. The configuration shown in FIG. 7 includes a wrap net accessory 170 and a first catch net bag accessory 180. The wrap net accessory 170 is configured to be stretched around an assembled frame to form a protective net wall. In the drawing, the assembled frame includes the first sub-frame 80 (one of the auxiliary attachment components) mounted to a pair of corner posts 21, which serves as an offset base for the rectangular assembled frame, the vertical members 84 and cross member 86 of the sub-frame forming the bottom half of the frame for the net 170. A U-shaped horizontal bar 50 (see FIG. 3A) is inserted into the openings 81*a* (see FIG. 3B) to form the upper half of the assembled rectangular frame for the net 170. The wrap net accessory 170 is constructed as an elongate, generally rectangular shaped netting 172 having a top or upper pocket section 174*a* and a bottom or lower pocket section 174*b* respectively. The pocket sections 174*a*, 174*b* form deformable sockets or compartments that fit over the respective top and bottom portions of the assembled frame in a stretched manner. The wrap net accessory 170 thus forms a stretched netting that substantially covers the assembled frame. This functions as an obstruction for objects being thrown against the stretched netting, as well as a protective barrier.

The assembled main frame can also be used to mount the second sub-frame 90 (see FIG. 3C) thereon. The second sub-frame 90 can be mounted in any user-defined adjusted manner to set the desired height and the size of the opening thereon. Additionally, as shown in FIG. 7, a first catch net bag accessory 180 can be detachably mounted to the second sub-frame 90 via a plurality of mounting mechanisms 182 connected to portions of the horizontal bars 92 and vertical bars 94 that define the periphery of the opening. The first catch net accessory 180 includes a generally elongate first catch bag netting 184, which, when attached to a frame, such as the opening in the adjustable second sub-frame 90, forms a bag adapted to catch any objects being thrown thereto. The mounting mechanisms 182 are preferably hanging rings that can easily fit over or around the portions of the horizontal bars 92 and vertical bars 94 and move freely thereon. Other mounting mechanisms 182 can include, but not limited thereto, strips of reinforced material with hook and loop fastener sections, snap-fit fasteners, ties, combinations and the like.

In use, the configuration of FIG. 7 is generally used as a simulated catcher. The user can throw balls or objects, such as baseballs and softballs, at the first catch net bag accessory 180 to practice the user's accuracy of throws and pitches. The opening defined by the combination of the adjustable horizontal bars 92 and the adjustable vertical bars 94 can be widened or narrowed in the vertical and/or horizontal directions to increase the difficulty and/or change the target point. The upper and bottom portions of the netting 172 forms a barrier or wall, preventing the thrown object from sailing past those points. The hanging catch net accessories 160 disposed to the sides of the configured reconfigurable sports training device 10 also form barriers or walls that prevent thrown objects from traversing past the sides of the reconfigurable sports training device 10. The hanging catch net accessories 160 absorb and dissipate much of the kinetic energy imparted by the thrown object when impacted thereon through deformation of the netting 164.

Figure 8:
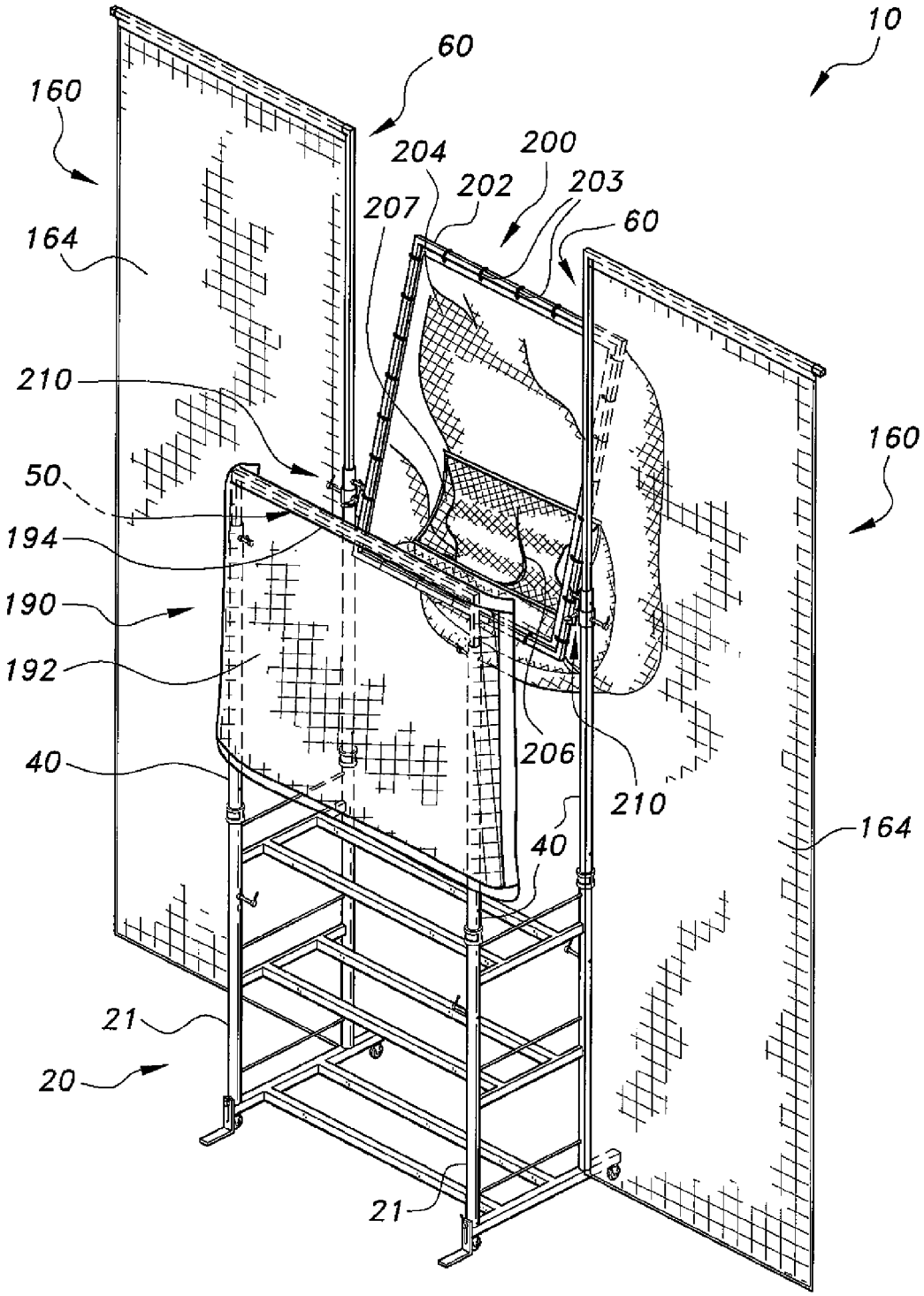
FIG. 8 is a perspective view of another configuration of the reconfigurable sports training device according to the present invention, showing various net accessories, primary and secondary attachment components, and a catch net accessory.

The configuration shown in FIG. 8 is designed to train skills in other sports, such as volleyball and football. This configuration is substantially similar to the one shown in FIG. 7 with the exception of a couple of different net accessories. As best seen in FIG. 8, the configuration includes a pair of elongate, hanging catch net accessories 160 suspended from the L-shaped upright bars 60 in the same manner as in the previous configuration. The hanging catch net accessories 160 are telescopically mounted to respective vertical extender posts 40. The configuration of FIG. 8 also includes a barrier net accessory 190 and a second catch net bag accessory 200.

The barrier net accessory 190 functions as a simulation of the types of nets used in such sports as tennis and volleyball, e.g., a net or barrier that the ball must travel over during play. In the configuration shown in FIG. 8, the barrier net accessory 190 simulates a volleyball net by attaching the barrier net accessory 190 to a U-shaped horizontal bar 50. The U-shaped horizontal bar 50 is telescopically mounted to a pair of vertical extender posts 40 on one side of the base 20 so that the horizontal member 52 is set at a desired elevated height, preferably a height that corresponds to regulations governing the sport. The barrier net accessory 190 includes an elongate netting 192 that has been reinforced along at least three edges. The remaining edge includes a mounting strip 194 to facilitate mounting the netting 192 onto any elongate member, such as the horizontal member 52. The mounting strip 194 can be provided with hook and loop fasteners and the like to facilitate folding the mounting strip 194 over the horizontal member 52 and securing the netting 192 thereon.

The second catch net bag accessory 200 includes a catch net frame 202, a second catch bag netting 204 detachably mounted to the catch net frame 202, and a mounting assembly 210 for selective mounting of the second catch net bag accessory 200 onto select primary and secondary attachment components. The catch net frame 202 provides structure or framework for mounting the catch bag netting 204 and suspending the netting 204 therefrom, as well as for defining the general shape of the opening for the catch bag netting 204. As shown in FIG. 8, the catch net frame 202 is generally rectangular or square in shape to maximize the size of the opening of the second catch bag netting 204. It should be understood, however, that the shape of the catch net frame 202 can include other shapes, such as circles, squares, triangles, or any other curvilinear or geometric shapes that can provide the framework to enable mounting of the second catch bag netting 204 and form the general shape of the opening. Moreover, the catch net frame 202 can also be provided in non-enclosed shapes, such as U-shapes, C-shapes, V-shapes, and the like, so long as these shapes can facilitate mounting of the second catch bag netting 204 and maintain the general shape of the opening.

The second catch bag netting 204 includes a plurality of mounting mechanisms 203 disposed around the open end of the second catch bag netting 204 to facilitate detachable mounting of the second catch bag netting 204 onto the catch net frame 202. The mounting mechanisms 203 can be hanging rings, similar to the hanging rings as the above first catch net bag accessory 180, as well as variants thereof. When suspended by the mounting mechanisms 203, the second catch bag netting 204 forms a bag shape that hangs from the catch net frame 202. Any balls or objects thrown at the second catch bag net accessory 200 will collect inside the bag shape of the second catch bag netting 204.

To ease removal of balls and objects, the second catch bag netting 204 can include an access patch or flap 207 disposed about the center of the second catch bag netting 204 As best seen in FIG. 8, the approximate center of the second catch bag netting 204 includes at least one access hole 206 covered by the access patch 207. The access hole 206 can be a slit or a shaped opening in the second catch bag netting 204, or overlapping portions of the second catch bag netting 204. The access patch 207 is secured at the top and bottom onto the second catch bag netting 204 and covers the access hole 206 so that the lateral sides or ends of the access patch 207 remain free. The free ends of the access patch 207 can be manipulated to form a deformable flap in order to create a gap between the access patch 207 and the portion of the second catch bag netting 204 near thereto. This configuration provides access to collected contents from the bottom of the bag shape by threading the user's arm through the access hole 206 and the gap formed thereby. It is desirable that the access patch 207 substantially covers access hole 206 in order preserve the integrity of the second catch bag netting 204 and to insure that the balls or objects will not unintentionally fall out of the second catch bag netting 204. In use, the removal of balls or objects can be facilitated in several ways. Generally, the most common method requires the user to access the contents of the second catch bag netting 204 through the opening of the bag shape or form defined by the shape of the catch net frame 202. Another method requires the user to access the contents from the bottom of the bag shape through the access hole 206 and the gap that can be formed with the access patch 207.

Figure 9:
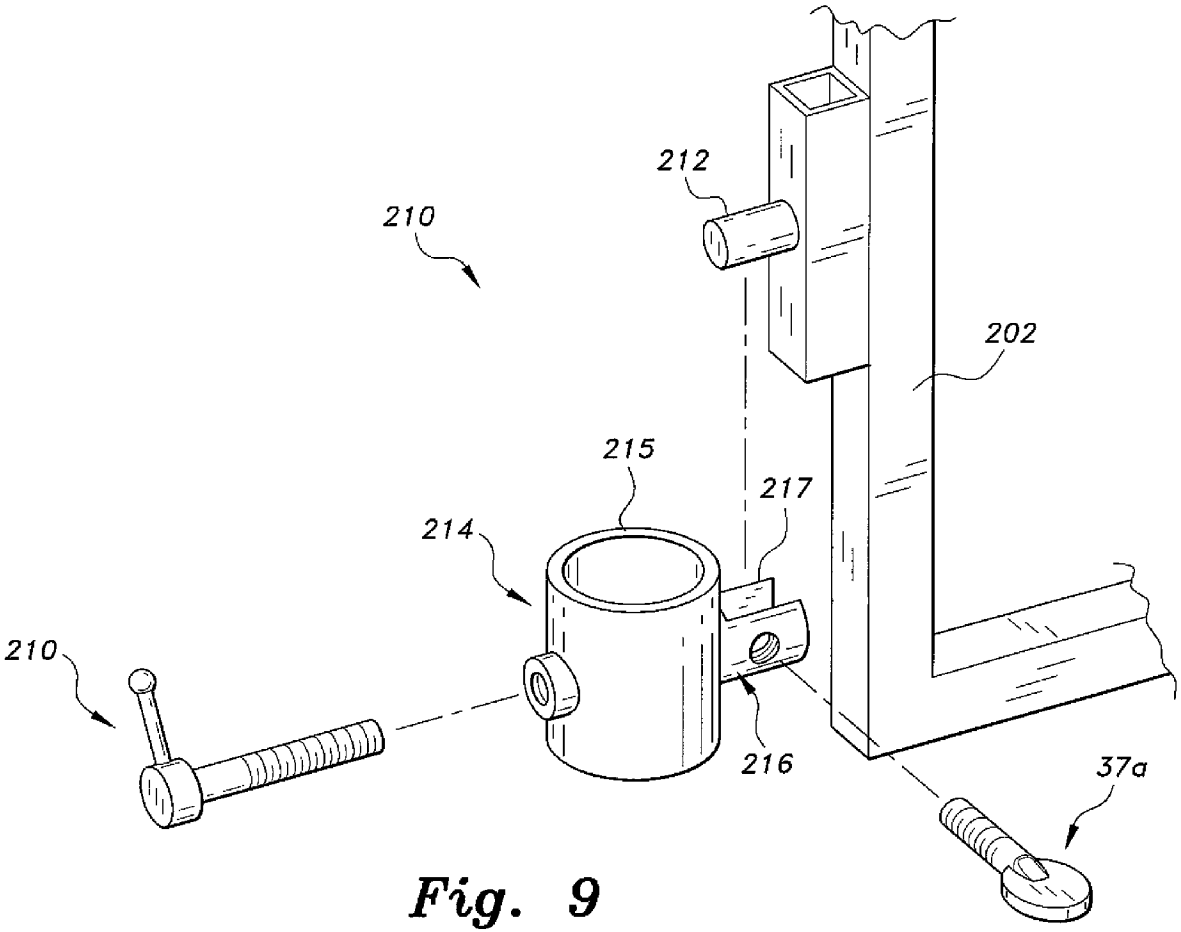
FIG. 9 is a detailed perspective view of a mounting assembly on the catch net accessory shown in FIG. 8, the netting being removed for clarity in the drawing.

As shown in FIG. 9, the mounting assembly 210 for the second catch net bag accessory 200 includes a pair of laterally extending mounting posts 212 projecting from opposite sides of the catch net frame 202 to mount the frame 202 between a pair of vertical supports, such as the vertical extender support posts 40. A pair of mounting brackets 214 slidably mounts to the vertical extender support posts 40, and the height thereof can be set by the user. Each mounting bracket 214 is preferably a circular sleeve 215 dimensioned to slidably mount over a corresponding vertical extender support post 40. Each circular sleeve 215 includes a mount saddle 216 radiating from the circumference of the sleeve 215 and a locking mechanism 37 coupled to the circular sleeve 215 to fix the adjusted height position of the second catch net bag accessory 200. Each mount saddle 216 is preferably configured as a relatively short semicircular tube 217 and a clamping lock mechanism 37*a* coupled thereto. The clamping lock mechanism 37*a* can be a thumbscrew or the like, as shown. Instead of the clamping lock mechanism 37*a*, the locking mechanism 37 may be used. The mounting posts 212 can be provided as relatively short, round stubs configured to be inserted into a corresponding mount saddle 216. The mounting posts 212 are arranged collinearly to define an axis. Once seated in the respective mount saddles 216, the catch net frame 202 can be tilted to adjust the angular disposition of the catch net frame 202 about the axis.

For volleyball use, players and users can practice passes to set up spikes, which hopefully will fly into the second catch net bag accessory 200. The elevated position of both the barrier net accessory 190 and the second catch net bag accessory 200 can be adjusted to accommodate players and users of varying heights and abilities. For football use, the player or user can practice throwing the football into the second catch net bag accessory 200, being cognizant of the height of the barrier net accessory 190. In this instance, the barrier net accessory 190 simulates the ideal height to arc the football over as the player throws a pass in order to bypass opponents who may be attempting to intercept the football. The tilted position of the second catch net bag accessory 200 can be adjusted to any desired angular position to ease capture of objects being thrown thereto, or to vary the difficulty of placing the thrown object.

Figure 10:
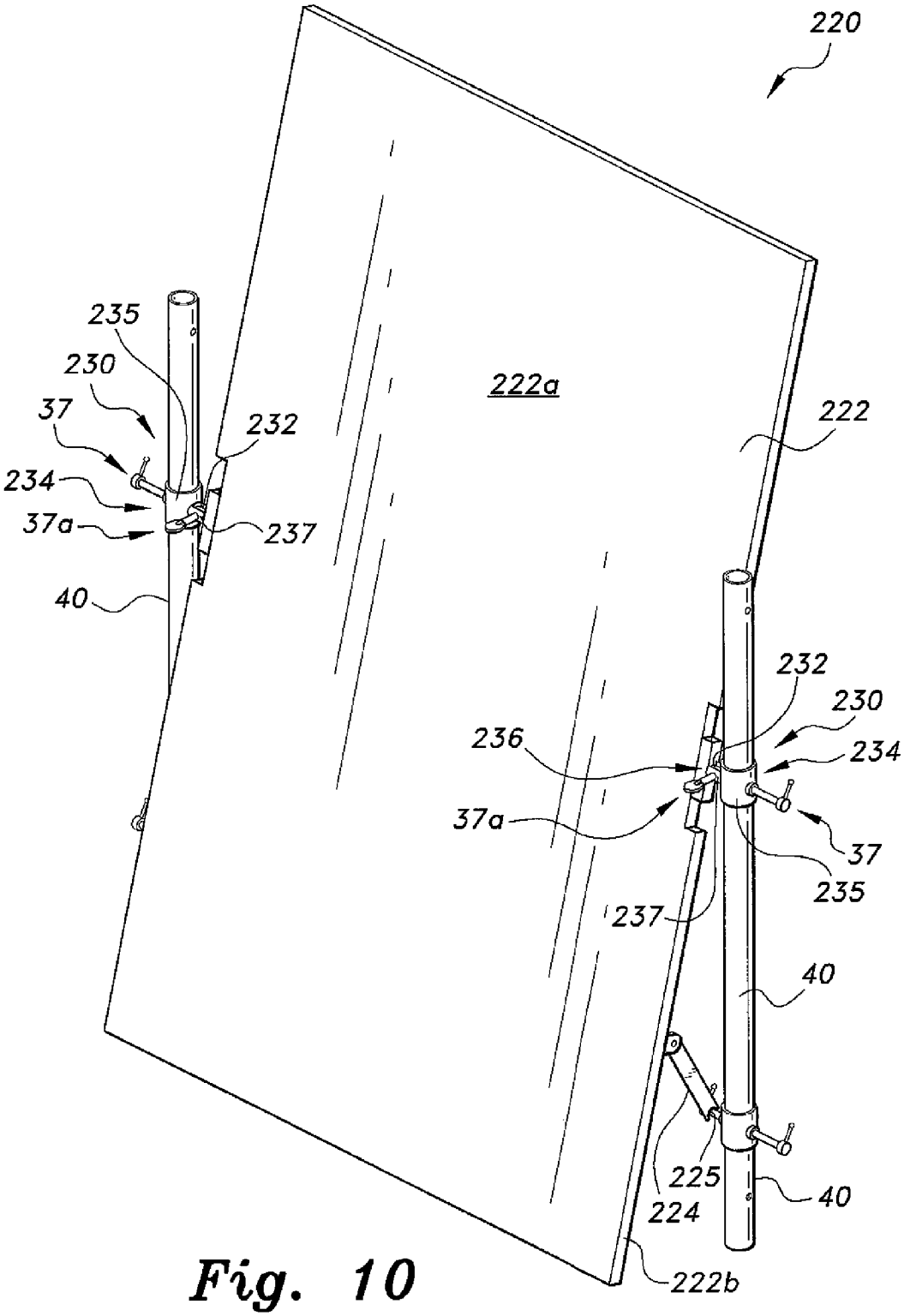
FIG. 10 is a perspective view of a universal rebound board accessory and exemplary assembly between a pair of vertical extender attachment posts in a reconfigurable sports training device according to the present invention.

Another multipurpose accessory is shown in FIG. 10. This accessory is a universal rebound board accessory 220. The universal rebound board accessory 220 includes an elongate, flat board 222 having a rebound front surface 222*a*, a rebound back surface 222*b*, and a mounting assembly 230 for mounting the universal rebound board accessory 220 between a pair of spaced vertical extender support posts 40. The flat board 222 is preferably rectangular in shape and preferably dimensioned to fit between the pair of spaced vertical extender support posts 40, at least in width. The mounting assembly 230 is preferably substantially the same as the mounting assembly 210 and includes a pair of mounting posts 232 extending from opposing lateral sides of the flat board 222 and discrete or separate mounting brackets 234 detachably mounted to a respective vertical extender support post 40. Each mounting bracket 234 is preferably a circular sleeve 235 dimensioned to slidably mount over a corresponding vertical extender support post 40. Each circular sleeve 235 includes a mount saddle 236 radiating from the circumference of the sleeve 235 and a locking mechanism 37 coupled to the circular sleeve 235 to fix the adjusted height position of the universal rebound board accessory 230. Each mount saddle 236 is preferably configured as a relatively short semicircular tube 237 and a clamping locking mechanism 37*a* coupled thereto. The mounting posts 232 can be provided as relatively short, round stubs configured to be inserted into a corresponding mount saddle 236. The mounting posts 232 are arranged collinearly to define an axis. Once seated in the respective mount saddles 236, the flat board 222 can be tilted to adjust the angular disposition of the flat board 222 about the axis.

The universal rebound board accessory 220 also includes features that provide stability and support to the tilted position of the flat board 222. As best seen in FIG. 10, the angle stabilizing means includes at least one elongate stabilizing leg 224 pivotally mounted at one end to one side of the flat board 222. The flat board 222 is preferably provided with a pair of stabilizing legs 224 disposed near opposite sides of the flat board 222. The pivoted connection of the stabilizing leg 224 enables the stabilizing leg 224 to fold into and out of a stowed position. In use, the stabilizing leg 224 pivots out so that the opposite end can be braced against an object to stabilize the tilted or angular position of the flat board 222. To that end, each stabilizing leg 224 can include an indention 225 at the opposite end to hook that end around an object, such as one of the locking mechanisms 37 mounted to the vertical extender post 40.

When assembled in this manner, the user can practice tossing and catching a ball for various sports by tossing the ball against the flat board 222 and catching the same on the rebound. For example, the user can use a lacrosse stick to fling a lacrosse ball against the flat board 222 and catching the same with the lacrosse stick. Similar activities can be facilitated by any sports that utilize a resilient ball, such as a basketball, handball, tennis ball, and the like.

Figure 11:
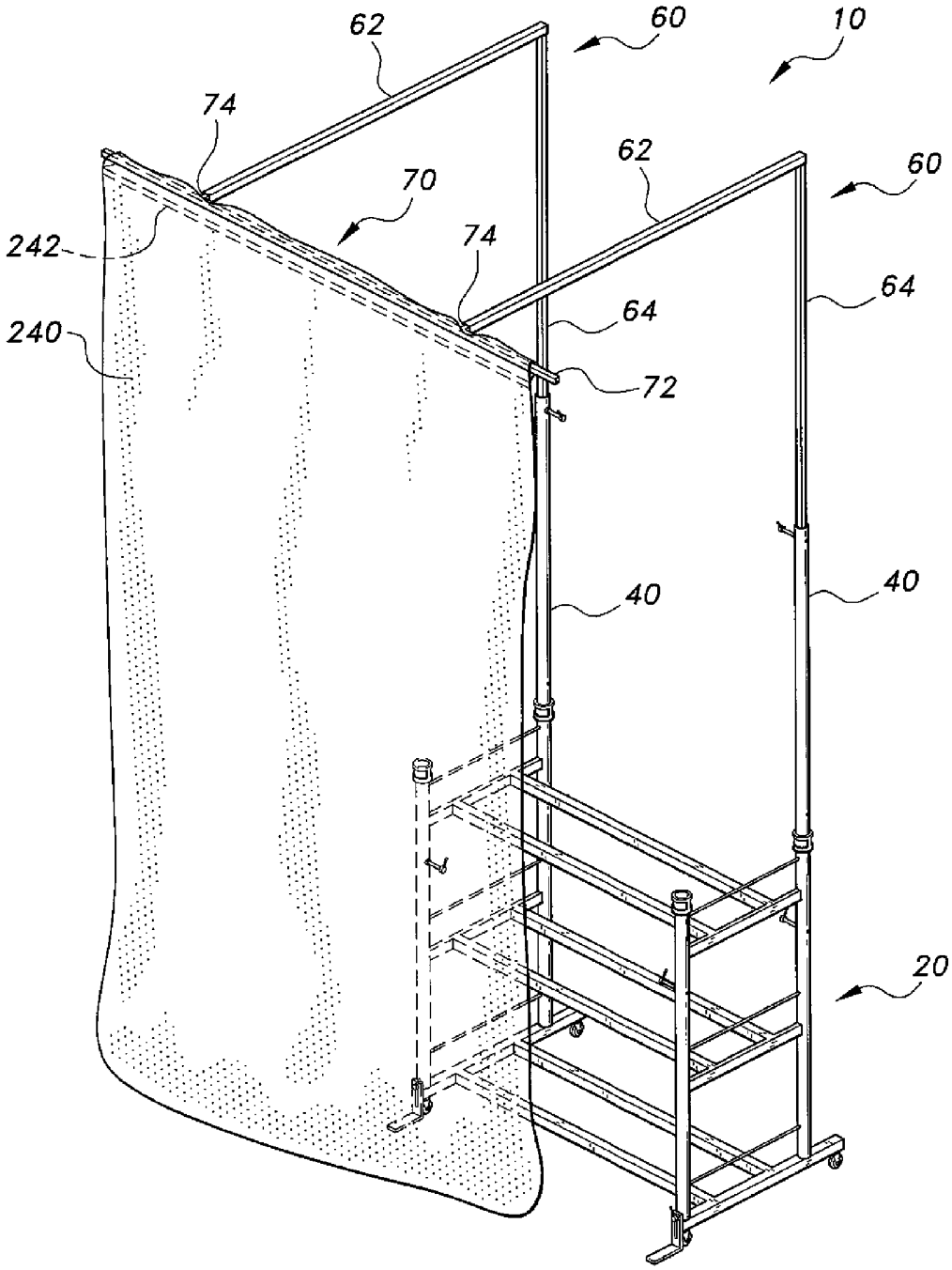
FIG. 11 is a perspective view of another configuration of the reconfigurable sports training device according to the present invention, showing various primary and secondary attachment components and a hanging catch curtain.

Another configuration is shown in FIG. 11, which is designed more for high impact activities, such as golf, baseball, softball and the like. This configuration includes a pair of L-shaped upright bars 60 telescopically mounted to respective vertical extender posts 40. Each L-shaped upright bar 60 has been positioned so that each horizontal member 62 points toward the front of the main base frame 20. A T-bar 70 is telescopically mounted to the openings 66 at the end of the horizontal member 62. When assembled in this manner, the horizontal member 72 of the T-bar 70 presents a structure for hanging or suspending other items thereon. This configuration alone can be used as a type of physical conditioning device by utilizing the horizontal member 72 as a pull-up bar. With this type of use, the main base frame 20 may require additional stabilization, such as by additional weights or bracing members, due to the weight of the user being supported by the T-bar 70. However, the more common use is to support an elongate curtain 240. The elongate curtain 240 is configured to provide a relatively large area for absorbing and dissipating the kinetic energy from objects impacting thereon. This curtain 240 functions similar to the elongate netting 164 in that the curtain 240 deforms substantially to facilitate the absorption. One end of the curtain 240 includes spaced, detachable fasteners 242 to enable selective mounting of the curtain 240 onto the horizontal member 72. The fasteners 242 can be hook and loop fasteners, snap-fit fasteners, and the like. The spacing of the fasteners 242 forms gaps to accommodate the mounting posts 74 during assembly.

In use, the relatively large area of the curtain 240 provides enhanced absorption for high impact objects, such as those that can occur from hitting golf balls, baseballs, softballs, and the like towards the curtain 240. Generally, the player or user stands a distance away from the curtain and hits the golf ball, baseball or softball with a golf club, baseball bat, or softball bat towards the curtain in order to practice their swinging techniques. The configuration shown in FIG. 11 places the curtain 240 a user-defined distance away from the main base frame 20, which also provides plenty of space for the curtain 240 to catch, deform, absorb, and dissipate the kinetic energy from the impact of the ball.

The dampening rate of the curtain 240 can be provided by many different factors, which mainly depend on the construction thereof. The curtain 240 can be an elongate sheet of netting, similar to the netting 164, which provides a certain degree of dampening. More preferably, the curtain 240 can be constructed from an elongate sheet of sturdy cloth or textile that can endure repeated impacts and include a relatively large surface area, such as that provided by textured surfaces. The sheet of cloth or textile can exhibit enhanced dampening characteristics with relatively minimal deformation. Additionally, the bottom of the curtain 240 is preferably left free so that the curtain 240 is not in tension in order to maximize dampening. If the curtain 240 is tensioned in some manner, then such a configuration will retard the deformation of the curtain 240 during impacts. It is contemplated that the bottom of the curtain 240 can be secured, especially when the curtain 240 extends longer than the length required to reach the floor. In this case, the bottom of the curtain 240 can be weighted, such as by an elongate rod or weighted objects placed on the pooling portions of the curtain 240 so that the bottom of the curtain 240 can still move and deform during impacts without placing too much tension on the overall curtain 240. When not in use for sports related activities, the configuration with the curtain 240 can also be used as a projection screen, a modesty screen, a partition, and the like.

Thus, it can be seen that the reconfigurable sports training device 10 provides a versatile tool to assist training in many different sports. All of the primary attachment components, secondary attachment components, and the various accessories can be interchangeably assembled to configure the reconfigurable sports training device 10 for specific sports or areas of training. Some of the accessories, such as the speed bag accessory 130 and the treadmill accessory 140, also provide physical conditioning capabilities to the reconfigurable sports training device 10. Depending on the needs of the user, the reconfigurable sports training device 10 can be provided in kit form that includes at least the main base frame 20 and one or more of the primary attachment components, secondary attachment components, and accessories.

It is to be understood that the reconfigurable sports training device 10 encompasses a variety of alternatives. For example, the main base frame 20, the primary attachment components, and the secondary attachment components can be constructed from durable materials, such as wood, plastic, metals, composites, and combinations thereof. The netting for the various net accessories is preferably constructed from durable materials, such as synthetic fibers, natural fibers, nylon, plastic, and combinations thereof to withstand the rigors of repeated use. Moreover, each netting is preferably reinforced on the edges to prevent premature tearing.

Furthermore, other types of accessories can be used as a measuring instrument. For example, an elongate rod (not shown) can be inserted into one of the corner posts 21 and secured thereon by the locking mechanism 37. A person can stand next to the secured elongate rod and perform height measurements thereby. As with the biased swing arms 100, this example highlights the possible configurations of the reconfigurable sports training device 10 that includes all aspects of sports activity, and not just the skills related to a specific sport.

It is to be understood that the present invention is not limited to the embodiments described above, but encompasses any and all embodiments within the scope of the following claims.

We claim:

1. A reconfigurable sports training device, comprising:

a movable main base frame, the main base frame having at least one shelf for storing equipment, the main base frame having a plurality of corner posts, each of the corner posts being hollow and having a mounting fixture at one end thereof;

at least one attachment component adapted for selective mounting to the main base frame, wherein the at least one attachment component comprises a plurality of primary attachment components and a plurality of secondary attachment components, wherein the plurality of secondary attachment components comprises a first sub-frame and a second sub-frame, the first sub-frame and the second sub-frame each being selectively mountable to said corners posts, wherein the first sub-frame comprises:

i) a pair of spaced, substantially hook-shaped upright bars, each of the hook-shaped upright bars having an elongate horizontal member, an elongate vertical member extending orthogonally from one end of the horizontal member, and an elongate insert member spaced parallel to the vertical member and depending from the opposite end of the horizontal member, the elongate vertical member and the elongate insert member each having at least one hole to selectively receive another attachment component or accessory; and ii) a cross member interconnecting the hook-shaped upright bars at the end of the respective elongate vertical members opposite the horizontal member; and at least one accessory adapted for selective mounting to the at least one attachment component, the at least one attachment component and the at least one accessory configuring the main base frame into a user-defined configuration for training at least one sports skill.

2. The reconfigurable sports training device according to claim 1, wherein the at least one shelf comprises:

a plurality of vertically spaced shelves extending between the corner posts, including a bottom shelf, each of the shelves having a pair of spaced elongate members and a pair of elongate cross members coupled to respective ends of the spaced elongate members, the bottom shelf having a pair of cross members longer than the rest of the cross members to increase stability of the main base frame; and a pair of casters mounted on each of the cross members of the bottom shelf to facilitate movement of the main base frame from one locale to another.

3. The reconfigurable sports training device according to claim 1, further comprising at least one brace selectively mounted to one of the corner posts and a locking mechanism securing the at least one brace to the corner post.

4. The reconfigurable sports training device according to claim 3, wherein the at least one brace each comprises an L-shaped bracket having an elongate leg member and an orthogonal leg member extending from one of the ends of the elongate leg member, the elongate leg member being mounted along the corresponding corner post by the locking mechanism, the elongate leg member having an elongate slot to adjust relative position of the at least one brace with respect to the corresponding post, the locking mechanism being inserted through the elongate slot.

5. The reconfigurable sports training device according to claim 1, wherein the plurality of primary attachment components comprises at least one vertical extender support post, at least one U-shaped horizontal bar, at least one L-shaped upright bar, and a T-bar, the primary attachment components being interchangeably mountable to the corner posts and to each other.

6. The reconfigurable sports training device according to claim 5, wherein the at least one vertical extender support post comprises:

a plurality of vertical extender support posts, each of the vertical extender support posts being an elongate hollow bar having an externally threaded end and at least one hole defined therein near the ends of the hollow bar, the mounting fixture of each said corner post on the main base frame having internal threads to securely mount the threaded end of the vertical extender support posts thereon; and at least one locking mechanism selectively coupled to the at least one hole to secure any component telescopically inserted into the vertical extender support post.

7. The reconfigurable sports training device according to claim 5, wherein the at least one U-shaped horizontal bar comprises a horizontal member and a pair of spaced, elongate leg members defining a U-shape, each leg member extending orthogonally from a respective end of the horizontal member, the leg members being telescopically inserted into a pair of said corner posts or a pair of said vertical extender posts for assembled use.

8. The reconfigurable sports training device according to claim 5, wherein the at least one L-shaped upright bar comprises a vertical member and a horizontal member extending orthogonally from one end of the vertical member, the vertical member and the horizontal member each having at least one open end to selectively receive another attachment component or accessory.

9. The reconfigurable sports training device according to claim 5, wherein the at least one T-bar comprises an elongate horizontal member and a pair of spaced mount posts extending orthogonally from the horizontal member, the mount posts facilitating selective mounting of the T-bar onto a pair of said corner posts, or to other attachment components or accessories.

10. The reconfigurable sports training device according to claim 1, wherein the second sub-frame comprises:

a pair of spaced, elongate horizontal bars defining opposing top and bottom sides of the second sub-frame, each of the horizontal bars having a pair of mounting brackets at opposing ends thereof to facilitate adjustable mounting of the horizontal bars onto other attachment components at selectable relative positions with respect to each other, a locking mechanism coupled to each of the brackets to fix the horizontal bars to the attachment components, and a locking pin insertable through at least one hole in each bracket to lock the bracket behind the attachment components; and at least a pair of spaced, adjustable vertical bars slidably mounted on the horizontal bars and defining opposing lateral sides of the second sub-frame, each of the vertical bars having a first follower at one end and a second follower at the opposite end, the first follower being slidably mounted to one of the horizontal bars and the second follower being slidably mounted to the other of the horizontal bars, each of the vertical bars being telescoping to facilitate self-adjustable extension and retraction in response to relative height adjustments between the pair of horizontal bars, the horizontal bars and the vertical bars defining an opening therebetween, the size of the opening being adjustable by selective height adjustments between the horizontal bars to lengthen or shorten the opening and by selective spacing adjustments between the vertical bars to narrow or widen the opening.

11. The reconfigurable sports training device according to claim 1, wherein the at least one accessory comprises:

at least one biased swing arm selectively coupled to one of the attachment components the at least one biased swing arm having an elongate telescoping bar, a mounting bracket attached to the telescoping bar to mount the biased swing arm onto the attachment component, a biased hinge assembly coupling the elongate telescoping bar to the mounting bracket, and a locking mechanism coupled to the mounting bracket to lock an adjusted position of the biased swing arm on the attachment component;

wherein the biased hinge assembly permits the elongate telescoping bar to pivot away from impacts against the elongate telescoping bar and return to a normal position.

12. The reconfigurable sports training device according to claim 1, wherein the at least one accessory comprises a physical conditioning accessory selected from the group consisting of a speed bag accessory configured to be selectively coupled to at least one of the attachment components and a treadmill accessory selectively coupled to the main base frame.

13. The reconfigurable sports training device according to claim 1, wherein the at least one accessory comprises a net accessory selected from the group consisting of a rebound net accessory, a hanging net accessory, a first catch net bag accessory, a tiltable second catch net bag accessory, and a barrier net accessory.

14. The reconfigurable sports training device according to claim 1, wherein the at least one accessory comprises sports trainers selected from a group consisting of a basketball hoop accessory and a tiltable rebound board accessory.

15. A reconfigurable sports training device, comprising:

a movable main base frame, the main base frame having at least one shelf for storing equipment, the main base frame having a plurality of corner posts, each of the corner posts having a mounting fixture at one end thereof;

at least one attachment component adapted for selective mounting to the main base frame, wherein the at least one attachment component comprises a plurality of primary attachment components and at least a first sub-frame, the first sub-frame being selectively mountable to the corners posts of the base frame, wherein the first sub-frame includes a pair of spaced, substantially hook-shaped upright bars, each of the hook-shaped upright bars having an elongate horizontal member, an elongate vertical member extending orthogonally from one end of the horizontal member, and an elongate insert member spaced parallel to the vertical member and depending from the opposite end of the horizontal member and a cross member interconnecting the hook-shaped upright bars at the end of the respective elongate vertical members opposite the horizontal member, wherein the plurality of primary attachment components comprises:

i) at least one vertical extender support post, wherein the at least one vertical extender support post comprises a plurality of vertical extender support posts, each of the vertical extender support posts being an elongate bar having a coupling end and at least one hole defined therein near the ends of the bar, the mounting fixture of each corner post on the main base frame having coupling fixtures to securely mount the coupling end of the vertical extender support posts thereon; and at least one locking mechanism selectively coupled to the at least one hole to secure any component telescopically inserted into the vertical extender support post;

ii) at least one U-shaped horizontal bar, wherein the at least one U-shaped horizontal bar comprises a horizontal member and a pair of spaced, elongate leg members defining a U-shape, each leg member extending orthogonally from a respective end of the horizontal member, the leg members being selectively telescopically inserted into a pair of the corner posts or a pair of the vertical extender posts for assembled use;

iii) at least one L-shaped upright bar, wherein the at least one L-shaped upright bar comprises a vertical member and a horizontal member extending orthogonally from one end of the vertical member, the vertical member and the horizontal member each having at least one open end to selectively receive another attachment component or accessory; and iv) a T-bar, wherein the at least one T-bar comprises an elongate horizontal member and a pair of spaced mount posts extending orthogonally from the horizontal member, the mount posts facilitating selective mounting of the T-bar onto a pair of said corner posts, or to other attachment components or accessories.

16. The reconfigurable sports training device according to claim 15, wherein the elongate vertical member, the elongate insert member and the cross member each have at least one hole at their respective ends to selectively receive another attachment component or accessory.

* * * * *